US012029247B2

(12) United States Patent
Rado

(10) Patent No.: US 12,029,247 B2
(45) Date of Patent: Jul. 9, 2024

(54) PERSONAL VAPORIZER FOR USE WITH VIAL VIA CONNECTING STRUCTURE

(71) Applicant: Vaporous Technologies, Inc., Torrance, CA (US)

(72) Inventor: J. Christian Rado, Torrance, CA (US)

(73) Assignee: Vaporous Technologies, Inc.

( * ) Notice: Subject to any disclaimer, the term of this patent is extended or adjusted under 35 U.S.C. 154(b) by 0 days.

(21) Appl. No.: 17/663,577

(22) Filed: May 16, 2022

(65) Prior Publication Data

US 2022/0273034 A1 Sep. 1, 2022

Related U.S. Application Data

(63) Continuation of application No. 17/152,785, filed on Jan. 19, 2021, now Pat. No. 11,330,841.

(60) Provisional application No. 62/962,125, filed on Jan. 16, 2020.

(51) Int. Cl.

| | |
|---|---|
| ***A24F 40/10*** | (2020.01) |
| ***A24F 40/42*** | (2020.01) |
| ***A24F 40/44*** | (2020.01) |
| ***A24F 40/46*** | (2020.01) |
| ***A24F 40/48*** | (2020.01) |

(52) U.S. Cl.

CPC ..... *A24F 40/42* (2020.01); *A24F 40/10* (2020.01); *A24F 40/44* (2020.01); *A24F 40/46* (2020.01); *A24F 40/48* (2020.01)

(58) Field of Classification Search

CPC ..... A24F 40/10; A24F 40/40; A24F 40/42; A24F 40/44; A24F 40/46; A24F 40/48; A24F 40/49

See application file for complete search history.

(56) References Cited

U.S. PATENT DOCUMENTS

| | | | | |
|---|---|---|---|---|
| 4,036,240 | A | 7/1977 | Murray, Jr. | |
| 7,988,479 | B2 * | 8/2011 | Hankins | H01R 13/625 439/314 |
| 8,910,639 | B2 | 12/2014 | Chang et al. | |

(Continued)

FOREIGN PATENT DOCUMENTS

| | | |
|---|---|---|
| CN | 202863984 U | 4/2013 |
| EP | 3175722 | 6/2017 |
| KR | 20130106009 A | 9/2013 |

OTHER PUBLICATIONS

International Search Report and Written Opinion for corresponding PCT Application No. PCT/US2021/014030 from USPTO dated Apr. 2, 2021.

(Continued)

*Primary Examiner* — Abdullah A Riyami
*Assistant Examiner* — Thang H Nguyen
(74) *Attorney, Agent, or Firm* — FisherBroyles, LLC; Glen L Nuttall

(57) ABSTRACT

A personal vaporizer is configured to be used with a separately-formed vial. The vial can be sandwiched between a proximal and distal portion of the vaporizer, which in turn can be releasably attached to, and powered by, a battery assembly. Attaching the proximal and distal portions, with the vial in place, can both hold the vial in place and provide access to the vial so that vaporizing media within the vial can flow to an atomizer of the vaporizer. The vaporizer can include a child-proof locking structure for releasably engaging the proximal and distal portions.

17 Claims, 27 Drawing Sheets

(56) References Cited

U.S. PATENT DOCUMENTS

| | | | | |
|---|---|---|---|---|
| 9,504,279 | B2 | 11/2016 | Chen | |
| 9,609,893 | B2 | 4/2017 | Novak, III et al. | |
| 9,750,284 | B2 | 9/2017 | Rado | |
| 9,861,135 | B2 | 1/2018 | Chen | |
| 10,004,264 | B2 | 6/2018 | Rado | |
| 10,021,909 | B2 | 7/2018 | Rado | |
| 10,188,145 | B2 | 1/2019 | Rado | |
| 10,188,146 | B2 | 1/2019 | Chen | |
| 10,219,541 | B2 | 3/2019 | Rado | |
| 10,244,792 | B2 * | 4/2019 | Rado | H05B 3/46 |
| 10,321,721 | B2 | 6/2019 | Rado | |
| 10,327,470 | B2 | 6/2019 | Rado | |
| 10,542,780 | B2 * | 1/2020 | Chung | A24F 40/485 |
| 10,791,762 | B2 | 10/2020 | Liu | |
| 10,791,763 | B2 | 10/2020 | Chen | |
| 10,893,703 | B2 | 1/2021 | Chen | |
| 10,893,706 | B2 | 1/2021 | Wei | |
| 2005/0051182 | A1 | 3/2005 | Hcu | |
| 2006/0110144 | A1 | 5/2006 | Fellows et al. | |
| 2009/0293888 | A1 | 12/2009 | Williams et al. | |
| 2011/0259972 | A1 | 10/2011 | Rosenthal | |
| 2011/0290239 | A1 * | 12/2011 | Bach | A61M 15/0065 128/200.14 |
| 2013/0152922 | A1 | 6/2013 | Benassayag et al. | |
| 2013/0247910 | A1 | 9/2013 | Postma | |
| 2014/0041655 | A1 | 2/2014 | Barron et al. | |
| 2014/0283859 | A1 * | 9/2014 | Minskoff | A24F 40/485 131/329 |
| 2014/0287607 | A1 * | 9/2014 | Gray | H01R 13/625 439/314 |
| 2015/0101606 | A1 | 4/2015 | White | |
| 2015/0117842 | A1 | 4/2015 | Brammer et al. | |
| 2015/0136158 | A1 | 5/2015 | Stevens et al. | |
| 2015/0208729 | A1 | 7/2015 | Monsees et al. | |
| 2015/0208730 | A1 * | 7/2015 | Li | A24F 40/485 131/329 |
| 2015/0222050 | A1 * | 8/2015 | Behning | H01R 13/6456 439/314 |
| 2015/0245662 | A1 | 9/2015 | Memari et al. | |
| 2016/0029696 | A1 | 2/2016 | Obeidallah | |
| 2016/0295919 | A1 | 10/2016 | Thomas, Jr. | |
| 2016/0360790 | A1 | 12/2016 | Calfee | |
| 2017/0006917 | A1 | 1/2017 | Alvarez | |
| 2017/0043998 | A1 | 2/2017 | Murison et al. | |
| 2018/0020730 | A1 * | 1/2018 | Alarcon | A24F 40/42 131/329 |
| 2018/0043115 | A1 * | 2/2018 | Gould | A61M 11/042 |
| 2018/0177240 | A1 | 6/2018 | Duque et al. | |
| 2019/0021395 | A1 * | 1/2019 | Qiu | A24F 40/485 |
| 2019/0022345 | A1 * | 1/2019 | Kotch | A61M 16/145 |
| 2019/0104768 | A1 * | 4/2019 | Domenici | A24F 40/44 |
| 2019/0175846 | A1 | 6/2019 | Terry et al. | |
| 2020/0015524 | A1 * | 1/2020 | Rado | A24F 40/46 |
| 2020/0253281 | A1 * | 8/2020 | Rogan | A24F 40/46 |
| 2022/0000180 | A1 | 1/2022 | Rogan et al. | |
| 2022/0002419 | A1 * | 1/2022 | Gao | A61P 37/06 |

OTHER PUBLICATIONS

Non-Final Office Action on corresponding (U.S. Appl. No. 17/152,785) dated May 7, 2021.

Final Office Action on corresponding (U.S. Appl. No. 17/152,785) dated Sep. 28, 2021.

Notice of Allowance on corresponding (U.S. Appl. No. 17/152,785) dated Jan. 21, 2022.

International Search Report for related PCT Application No. PCT/US2021/014030 from USPTO dated Apr. 2, 2021.

Written Opinion for related PCT Application No. PCT/US2021/014030 from USPTO dated Apr. 2, 2021.

* cited by examiner

PERSONAL VAPORIZER FOR USE WITH VIAL VIA CONNECTING STRUCTURE

CROSS-REFERENCE TO RELATED APPLICATIONS

This application is a continuation of U.S. application Ser. No. 17/152,785, which was filed on Jan. 19, 2021, which claims priority to U.S. provisional application 62/962,125, which was filed Jan. 16, 2020. The entirety of each of these applications is hereby incorporated by reference.

BACKGROUND

The present disclosure relates to the field of personal vaporizers.

Personal Vaporizers are handheld devices that atomize a vaporizing medium such as an essential oil-based fluid or wax, e-liquid, concentrated cannabidiol, or the like. The atomized medium is typically mixed with air so as to form a vapor that is then inhaled by its user.

Vaporizing media comes in a wide range of varieties and can have varying properties. For example, some media has a very low viscosity, while other media is highly concentrated, having such a high viscosity that it does not readily flow at room temperatures. Still further media is provided in a substantially solid form, such as a concentrated wax or crystal.

Some styles of personal vaporizers employ a tank for holding a liquid vaporizing medium. An atomizer can be disposed below or near the bottom of the tank, and a vapor path extends through or to a side of the tank to deliver vapor from the atomizer to a mouthpiece positioned atop, or proximal of, the tank. While this general configuration has proven popular, filling the tank tends to be slow and difficult, particularly in the context of mass production. It also leads to misfilling and spilling, causing waste of product and fouling of vaporizers. Further, once filled, the tank is prone to leaking, and although media usually is somewhat protected from the environment while in the tank, typically such media is not truly sealed from the environment, and thus is susceptible to oxidation and other fouling during periods of nonuse.

SUMMARY

The present disclosure discloses aspects that improve personal vaporizers. For example, some embodiments disclose structure in which a proximal portion of a vaporizer is releasably connectable with a distal portion of a vaporizer, with a sealed vial sandwiched between. Attaching the proximal and distal portions also opens the vial so that media within the vial can be delivered to an atomizer. In additional embodiments, a child-proof connection can be used to connect the proximal and distal portions.

DESCRIPTION

Figure 1:
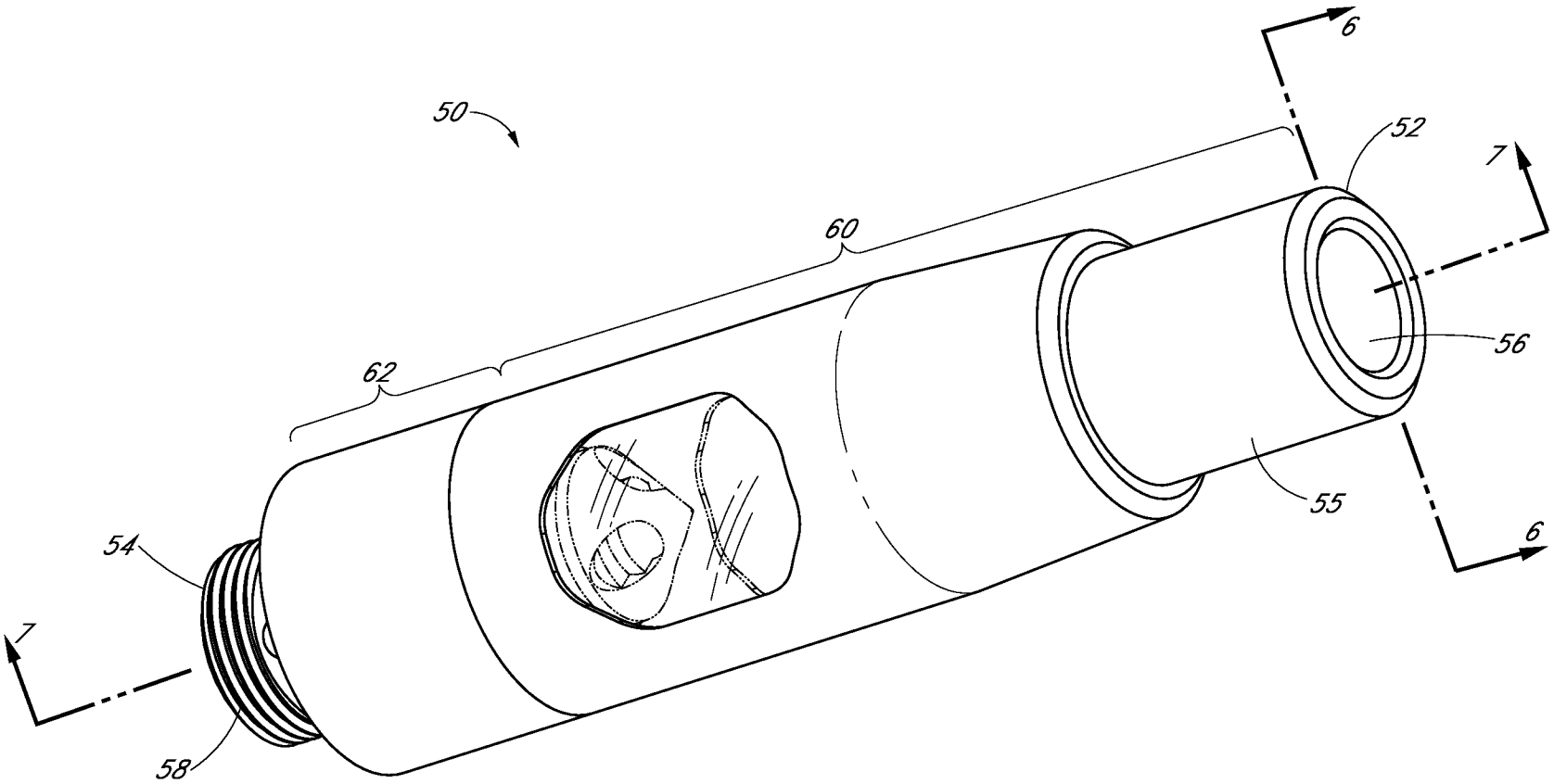
FIG. 1 is a perspective view of an embodiment of a personal vaporizer.
Figure 2:
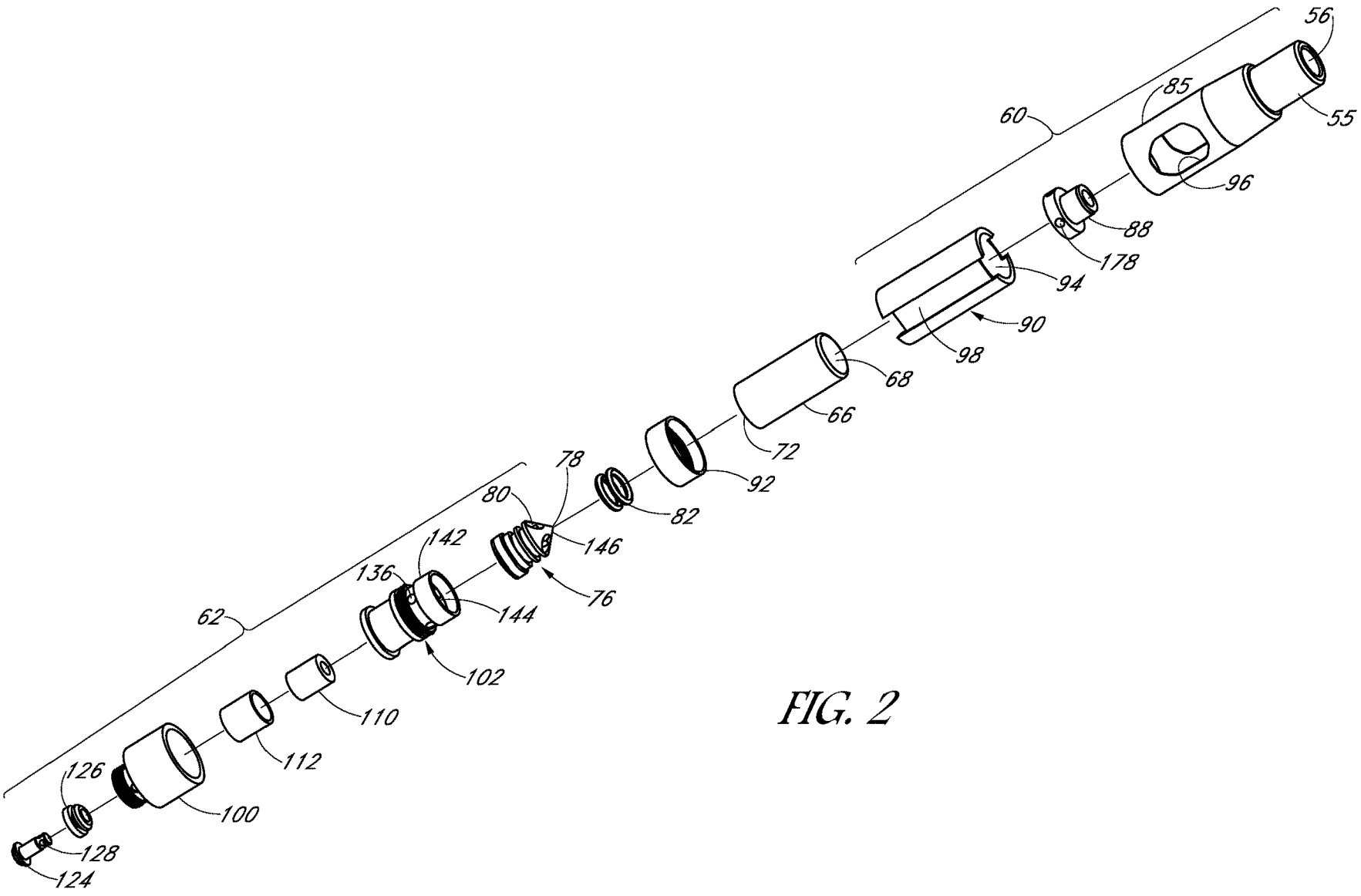
FIG. 2 is an exploded view of the personal vaporizer of FIG. 1.

The present specification describes inventive aspects in the context of embodiments of a personal vaporizer configured to use a separately-formed media vial rather than employing its own media storage tank. Such vials are filled independently, so that the personal vaporizer is totally removed from the filling process. Also, such vials can be sealed so as to better protect the vaporizing media from the environment during the period between filling and use. Notably, information concerning operation, manufacturing, attributes and use of embodiments of personal vaporizers can be found in the inventor's U.S. Pat. No. 10,244,792 (the '792 patent) and copending US Pub 2020/0015524 (the '524 publication), both of which are hereby incorporated by reference.

With initial reference to FIGS. 1-5, a personal vaporizer 50 extends from a proximal end 52 to a distal end 54. A mouthpiece portion 55 has a vapor outlet 56—or mouthpiece opening—at the proximal end 52. A battery connector 58 is disposed at the distal end 54 and is configured to connect to a conventional battery module. For example, the battery connector 58 can be configured in compliance with the "510" standard, although other configurations can be acceptable. As shown, a proximal portion 60 of the vaporizer 50 is selectively detachable from a distal portion 62 of the vaporizer 50 so that a media vial 66 can be placed within—or removed from—the vaporizer 50.

Figure 3:
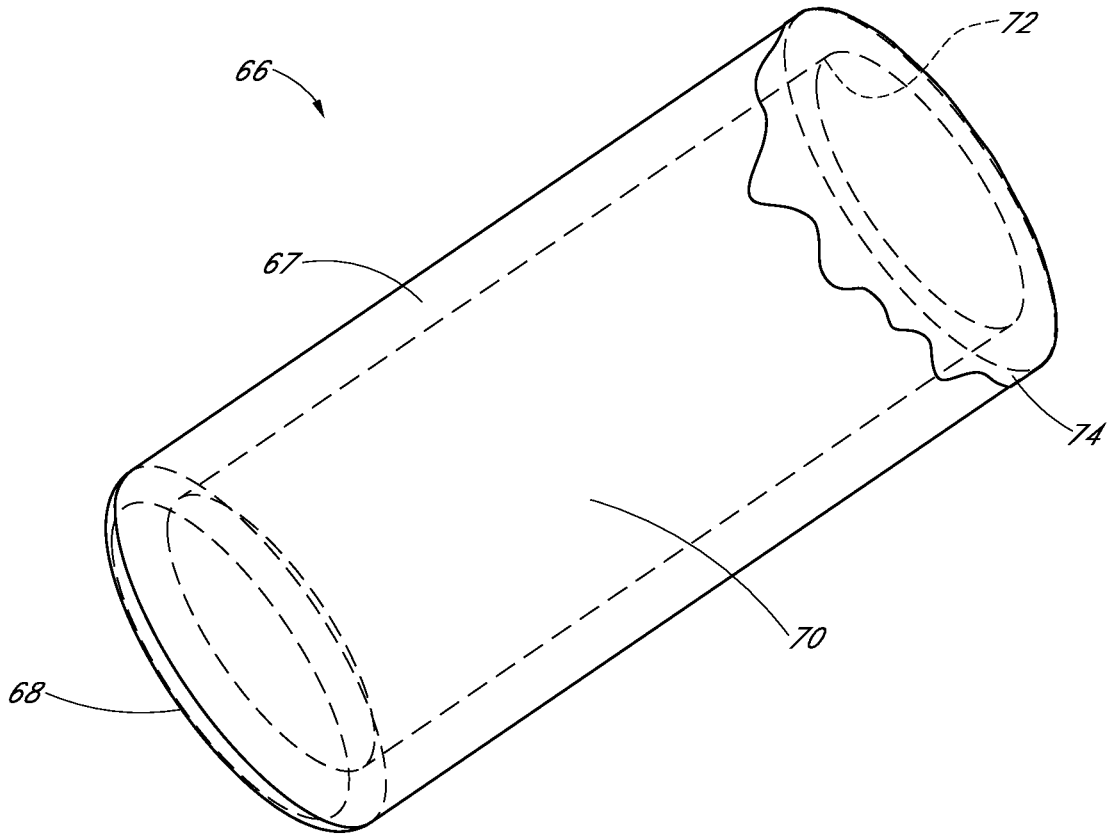
FIG. 3 is a perspective view of an embodiment of vial for use with the personal vaporizer of FIG. 1.

With particular reference to FIG. 3, an embodiment of a media vial 66 is elongated and comprises a circumferential side wall 67 and an end wall 68 that define a media tank 70 therewithin. An open end 72 provides access to the media tank 70. In a preferred embodiment, the media vial 66 is formed of glass so that the media within the vial 66 is visible. Preferably, after the vial 66 is filled with vaporizing medium, a stopper 74 is applied to the open end 72 to seal the media tank 70. As such, vaporizing medium in the tank 70 is totally sealed from the environment. In a preferred embodiment, the stopper 74 comprises an impermeable membrane, such as a thin foil cover, that is adhered about the entire circumference of the open end 72. In some embodiments the stopper 74 may include a tab configured to facilitate a user removing the stopper. In the illustrated embodiment, the stopper 74 is configured to be easily punctured when placed within the vaporizer 50.

Figure 4:
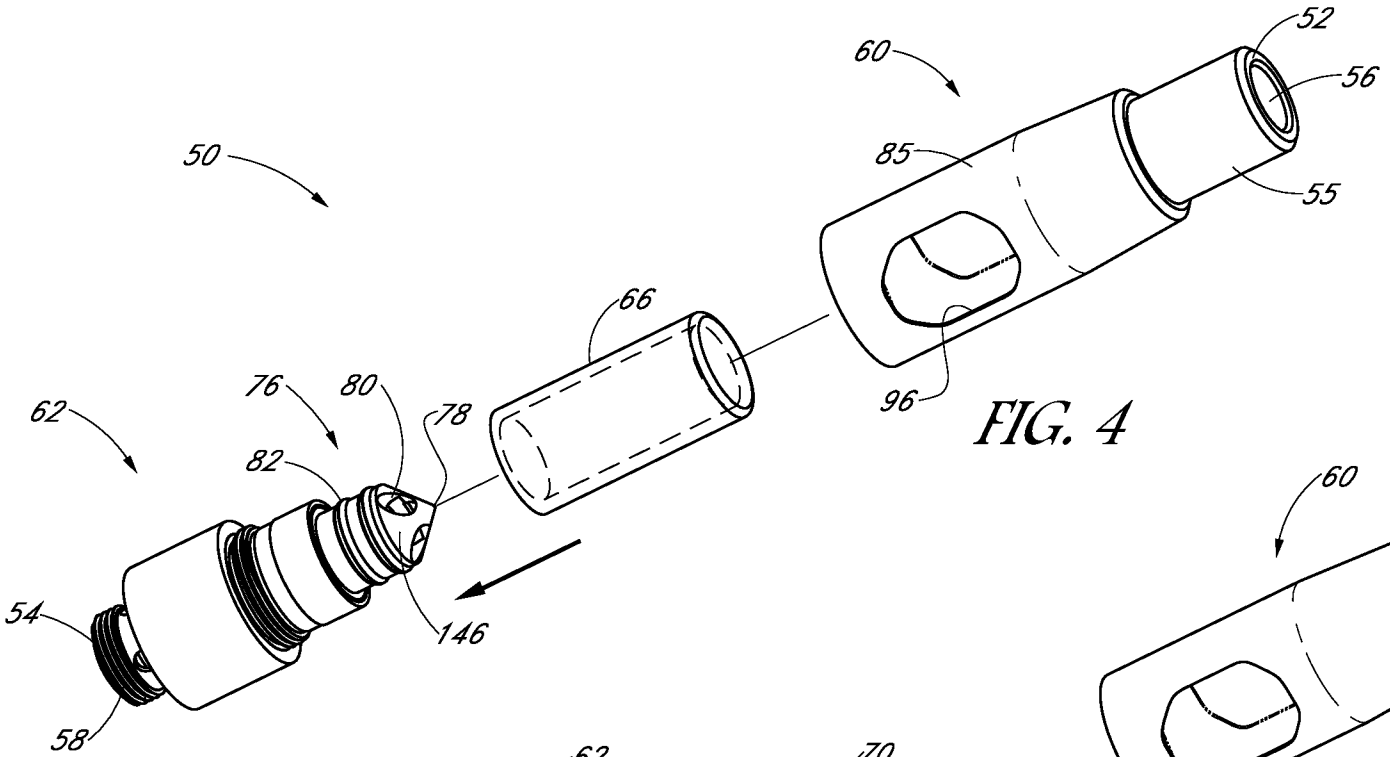
FIG. 4 is a perspective view of a vial being inserted into a personal vaporizer.
Figure 5:
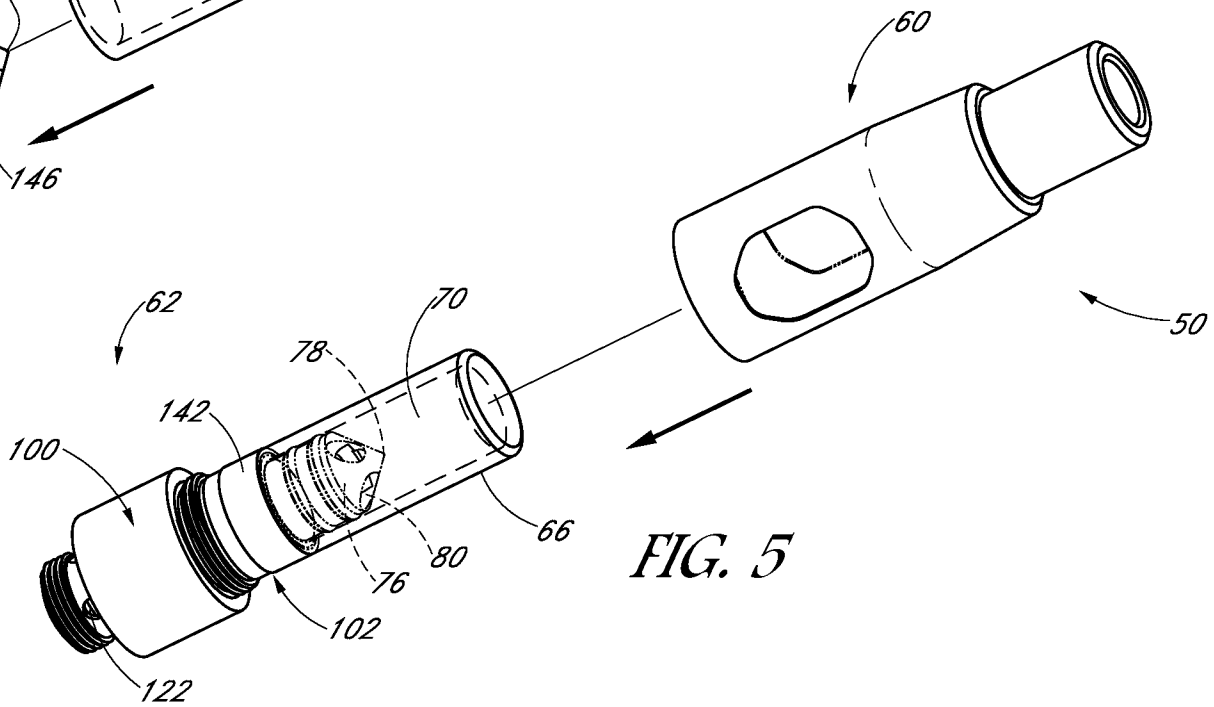
FIG. 5 shows the arrangement of FIG. 4 during further insertion.

With particular reference next to FIGS. 4 and 5, when the proximal portion 60 of the vaporizer 50 is removed from the distal portion 62, an elongated vial receiver 76 is revealed. The illustrated vial receiver 76 is elongated and comprises a puncture tip 78 at its proximal end along with a plurality of feeder holes 80. Distal of the puncture tip 78, the vial receiver 76 is sized and configured to be substantially complementary to the inner surface of the vial's side wall 67. The illustrated vial receiver 76 includes a pair of o-rings 82. As shown, the vial 66 is positioned so that its open end 72 faces the vial receiver 76 and the vial 66 is then pushed onto the vial receiver 76 so that the puncture tip 78 punctures the stopper 74 and enters the media tank 70 of the vial 66 as the vial is pushed distally over the o-rings 82. As such, the vial is sealingly attached to the vial receiver 76, which in turn is positioned within the vial's media tank 70. Vaporizing media M within the media tank 70 is placed into communication with the feeder holes 80. The proximal portion 60 of the vaporizer 50 can then be reattached to the distal portion 62 so that the media vial 66 is sandwiched therebetween and held within the personal vaporizer 50.

In some embodiments, the media vial 66 can be placed within the proximal portion 60 of the vaporizer first, and the proximal portion 60 is then attached to the distal portion 62. During such attachment the vial 66 will be urged onto the vial receiver 76 so that the puncture tip 78 punctures the stopper 74 and enters the media tank 70.

Continuing with reference to FIGS. 1-7, the proximal portion 60 of the vaporizer 50 comprises an outer sleeve 85 portion and a mouthpiece portion 55 that, in the illustrated embodiment, are unitarily formed. A mouthpiece insert 88 is received within the outer sleeve 85, as are a guide 90 and a connector piece 92. The connector piece 92 preferably is press-fit at a distal end of the outer sleeve 85, and the elongated guide 90 is sandwiched between the mouthpiece insert 88 and the connector piece 92. As such, the proximal portion 60, which includes the outer sleeve 85 portion, mouthpiece portion 55, mouthpiece insert 88, guide 90 and connector piece 92, moves together as a unit.

Figure 10:
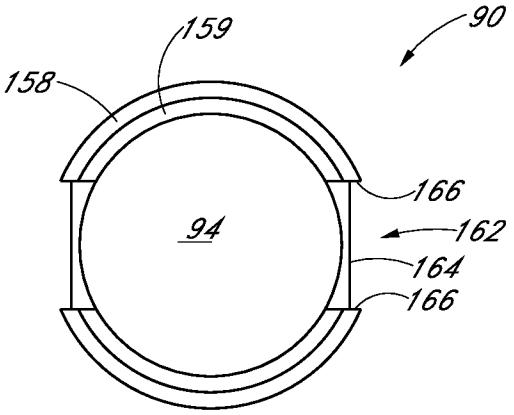
FIG. 10 is an end view of the guide portion of FIG. 8.
Figure 9:
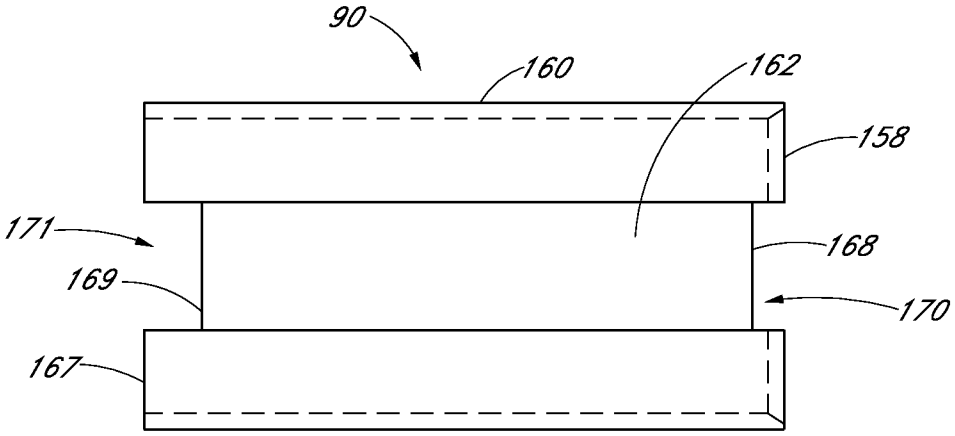
FIG. 9 is a side view of the guide portion of FIG. 8.
Figure 8:
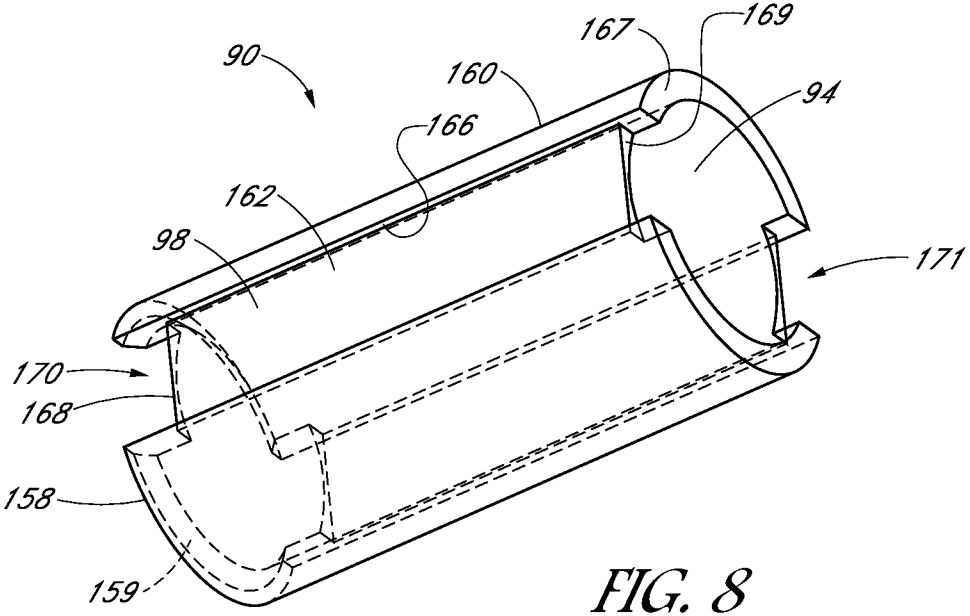
FIG. 8 is a perspective view of a guide portion for use with the personal vaporizer of FIG. 1.

With additional reference to FIGS. 8-10, the guide 90 preferably defines an elongated guide lumen 94 that—preferably—is complementary to the outer surface of the vial 66 so that the vial is slidingly received into the guide lumen 94 and is held securely—and preferably snugly—therewithin. The outer sleeve 85 includes a pair of windows 96 formed through opposite sides. In the illustrated embodiment the windows 96 are open apertures formed through the outer sleeve 85. In additional embodiments the windows could include transparent inserts and/or comprise a transparent portion of the outer sleeve 85. The guide 90 preferably is formed of a transparent material, such as a transparent plastic or glass, so that the vial 66—and the level of media therewithin—can be observed through the windows 96 when the vial 66 is disposed within the vaporizer 50.

As will be discussed in more detail below, the guide 90 cooperates with the outer sleeve 85 to define a pair of elongated, longitudinal vapor paths 98 past the vial 66 and spaced from the windows 96.

With reference again to FIG. 1-7, the distal portion 62 comprises a base 100 into which a base insert 102 is fitted—press-fitted in a preferred embodiment. The base insert 102 is elongated and defines a heating element receiver 104 on a distal side thereof. An elongated tubular wick 110 is disposed within the element receiver, and preferably is surrounded by a gasket 112, such as a cotton gasket. In the illustrated embodiment, the tubular wick 110 comprises a ceramic wick, which comprises a porous ceramic material within which a heating element in the form of a heating coil 114 is embedded. When electricity is supplied across opposing ends of the heating coil 114, the ceramic wick 110 is heated sufficiently to atomize vaporizing media M in contact with and adjacent the ceramic wick 110. Preferably, the ceramic material is sufficiently porous so that vaporizing media M can be drawn therethrough. The illustrated wick 110 is tubular, defining a vaporizing chamber 120 therewithin and along its axis. Of course, other embodiments and types of wicks, such as cotton or silica wicks or the like, can be employed.

The base 100 preferably is formed of an electrically conductive material such as a metal. The distal end 54 of the base 100 is a battery mount 58 that preferably comprises an externally threaded portion configured to threadingly engage a proximal mount boss of a typical battery. Intake air holes 122 are formed adjacent the distal end 54. The externally threaded portion of the base 100 defines an elongated inner lumen that receives an elongated conductive pin 124 (or power pin) therewithin. A distal insulating ring 126 is positioned between the conductive pin 124 and the distal end of the base 100. The distal insulating ring 126 electrically insulates the conductive pin 124 from the base 100. As in embodiments discussed in connection with the '792 patent and '524 publication, which are incorporated by reference, a distal end of the conductive pin 124 extends distally from the distal end 54 of the base housing 100 and is configured to engage a first pole of a battery, when attached, while the distal end 54 of the base housing 100 is configured to simultaneously engage a second, opposite, pole of the battery, when attached.

The conductive pin 124 preferably is hollow, defining an open distal end. Openings 128 are also provided at or adjacent a proximal end of the distal conductive pin 124. Both the pin openings 128 and the intake air holes 122 of the base 100 open into a base air space 130 that is distal of the wick 110 and which communicates with the vaporizing chamber 120.

The conductive pin 124 preferably is hollow, defining an open distal end. Openings 128 are also provided at or adjacent a proximal end of the distal pin 124. Both the pin openings 128 and the intake air holes 122 of the base 100 open into a base air space 130 that is distal of the wick 110 and which communicates with the vaporizing chamber 120.

Preferably, opposing ends of the heating coil 114 are accessible outside of the ceramic wick 110 so that electricity can be applied across the opposing ends. Most preferably, the opposing ends of the heating coil 114 are arranged in contact with the conductive pin 124 and the base 100, respectively, so that an electric circuit can be established from the first battery pole through the conductive pin 124 to the heating coil 114, and from the heating coil 114 to the base 100 and further to the second battery pole in a manner similar to embodiments discussed in the '792 patent and '524 publication, which are incorporated by reference. Such connections are not shown in the illustrated embodiment, but can take any of multiple forms and configurations.

Figure 6:
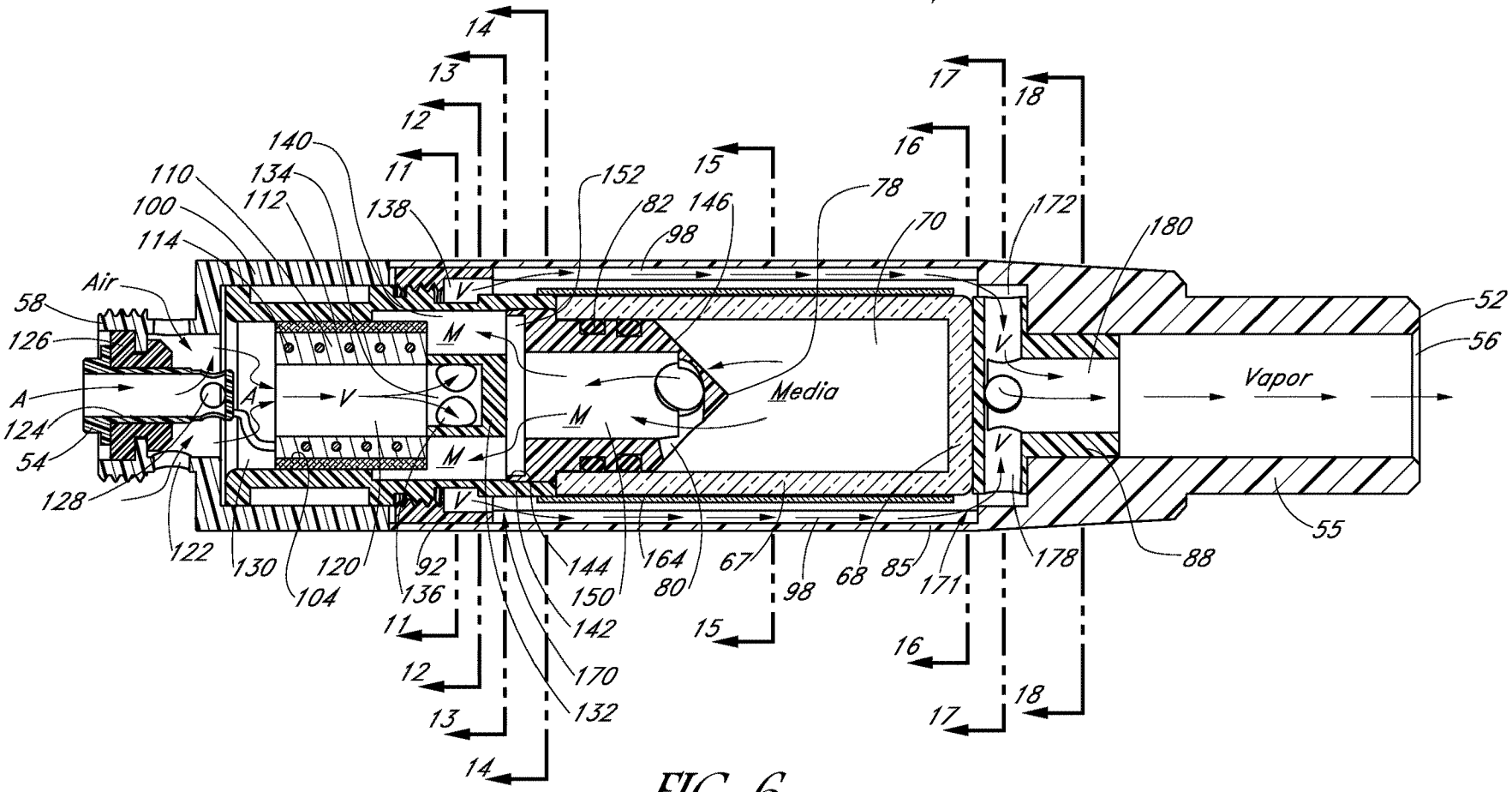
FIG. 6 is a cross-sectional view taken along line 6-6 of FIG. 1.
Figure 7:
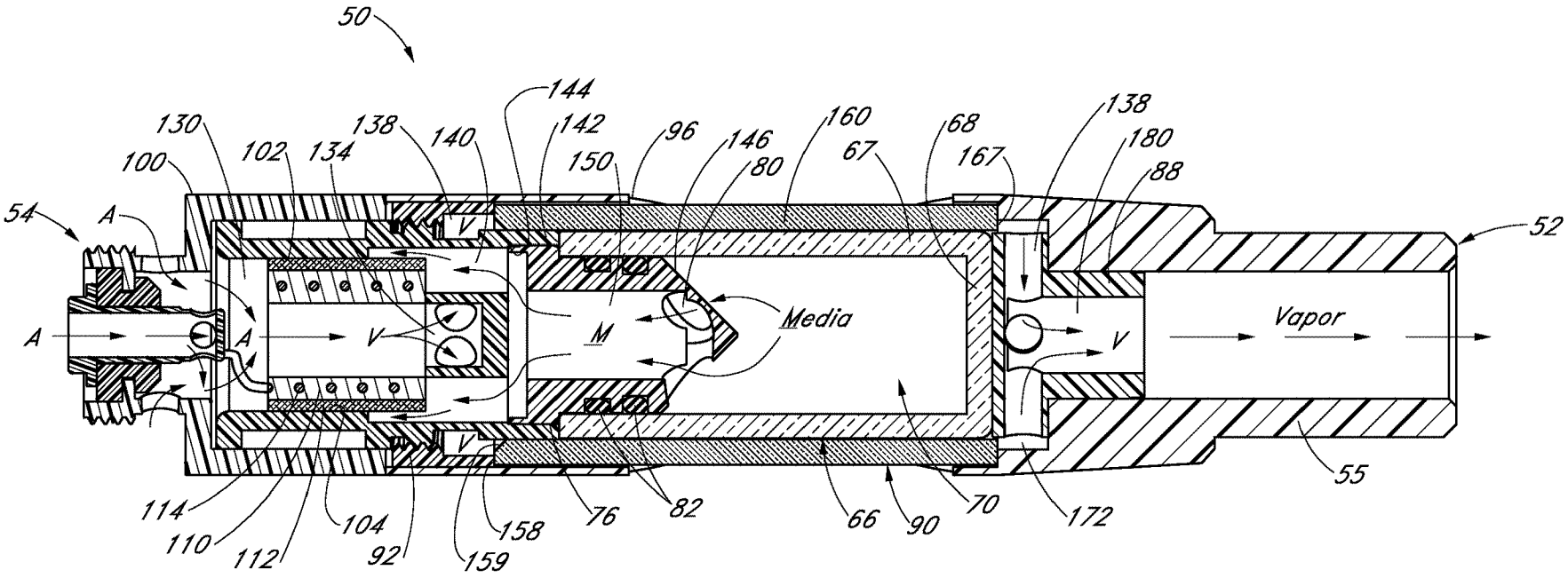
FIG. 7 is a cross-sectional view taken along line 7-7 of FIG. 1.

In the illustrated embodiment, a set of external threads is disposed on the base insert 102. The external threads are configured to threadingly engage the internal threads of the connector piece 92 of the proximal portion. As such the proximal portion 60 can be threadingly connected to the distal portion 62 by this threaded attachment, as best illustrated in FIGS. 6 and 7.

Figure 13:
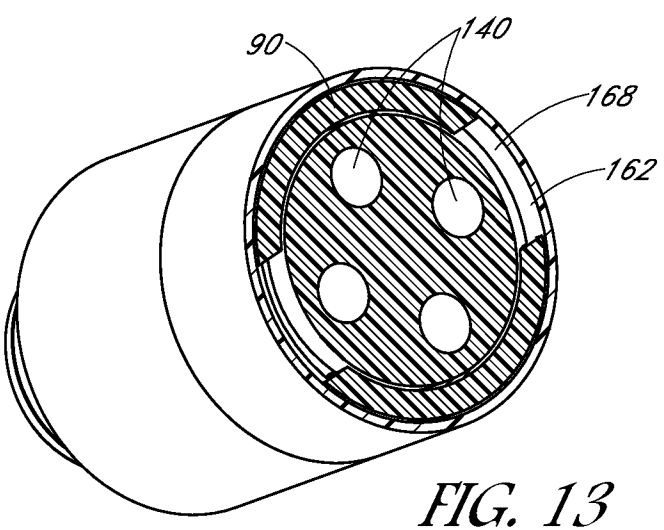
FIG. 13 is a cross-sectional view taken along line 13-13 of FIG. 6.
Figure 11:
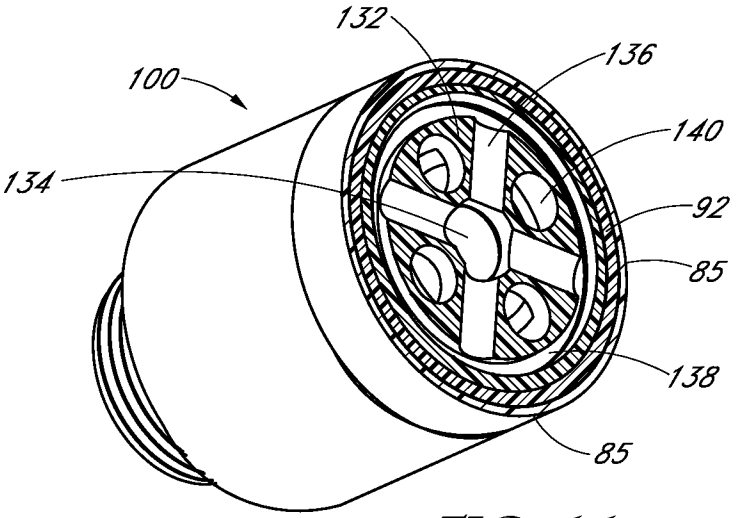
FIG. 11 is a cross-sectional view taken along line 11-11 of FIG. 6.
Figure 12:
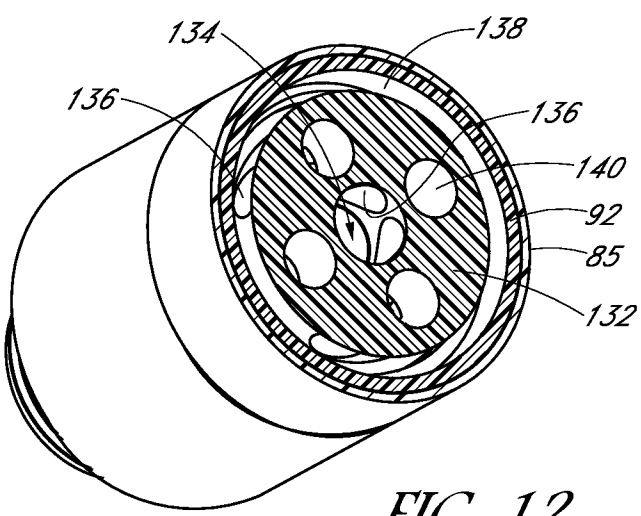
FIG. 12 is a cross-sectional view taken along line 12-12 of FIG. 6.
Figure 16:
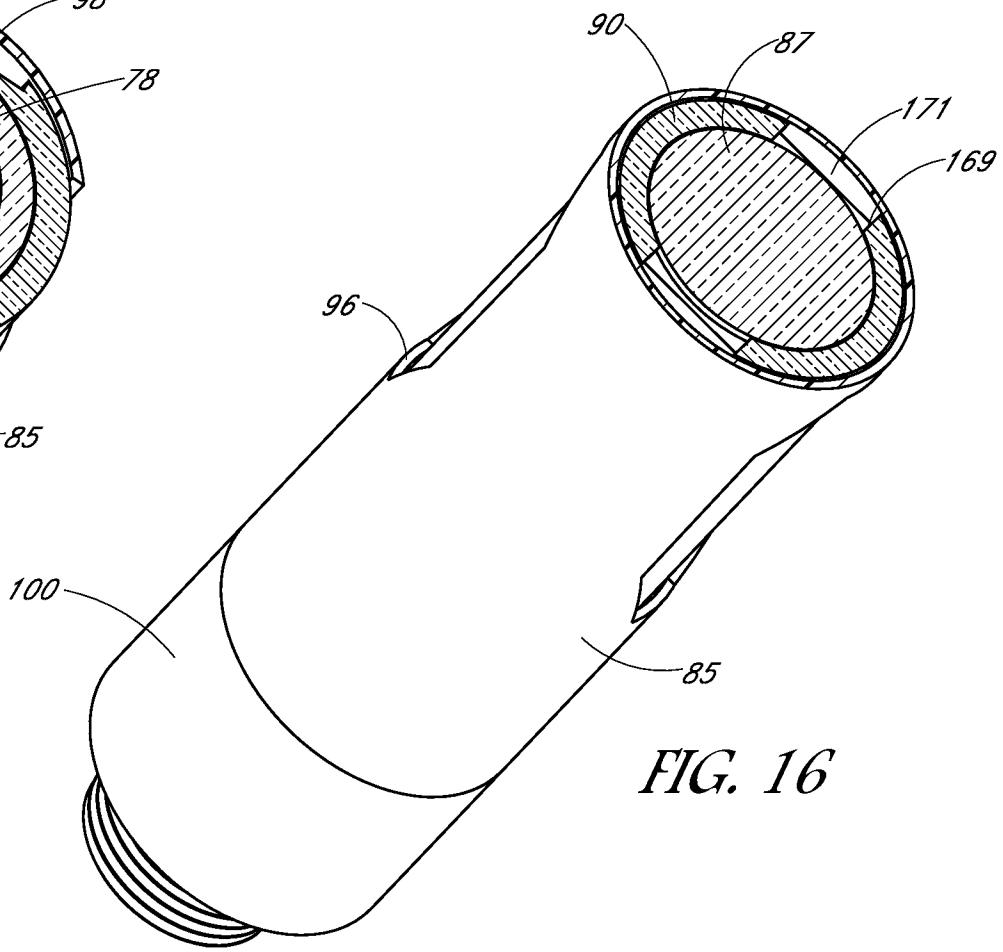
FIG. 16 is a cross-sectional view taken along line 16-16 of FIG. 6.

With additional reference to FIGS. 11-13, a transition zone 132 of the base insert 102 is generally proximal of the wick receiver. A vapor collector 134 of the transition zone 132 is disposed immediately proximal of the vaporizing chamber 120 so that vapor V flows from the vaporizing chamber 120 into the vapor collector 134. The vapor collector 134 is a space into which a plurality of radially directed vapor passages 136 open. The radially directed vapor passages 136 communicate vapor from the vapor collector 134 to a distal vapor manifold 138 defined between the base insert 102 and the outer sleeve 85 proximal of the threaded attachment. Notably, the illustrated distal vapor manifold 138 is radially spaced from the axis of the vaporizer 50.

The transition zone 132 also comprises a plurality of longitudinally extending media passages 140 that do not communicate with the vapor collector 134 or radial vapor passages 136. The longitudinally extending media passages 140 communicate directly with the ceramic wick 110 and surrounding cotton gasket 112. In the illustrated embodiment, at least a portion of each longitudinally extending media passage 140 extends distally at least part of the way along the length of the wick 110 and gasket 112. Vaporizing media M from the media vial 66 flows through the longitudinally extending media passages 140 and directly to the ceramic wick 110 and into the ceramic wick 110 through the cotton gasket 112.

The illustrated base insert 102 additionally comprises a proximally extending proximal wall 142 about its circumference. The proximal wall 142 defines a vial receiver seat 144 and is configured to receive a distal end of the vial receiver 76, preferably in a secure, press-fit manner.

Figure 14:
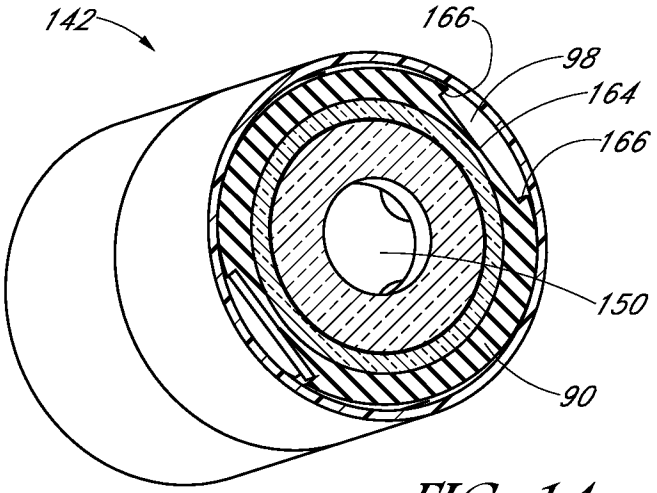
FIG. 14 is a cross-sectional view taken along line 14-14 of FIG. 6.
Figure 15:
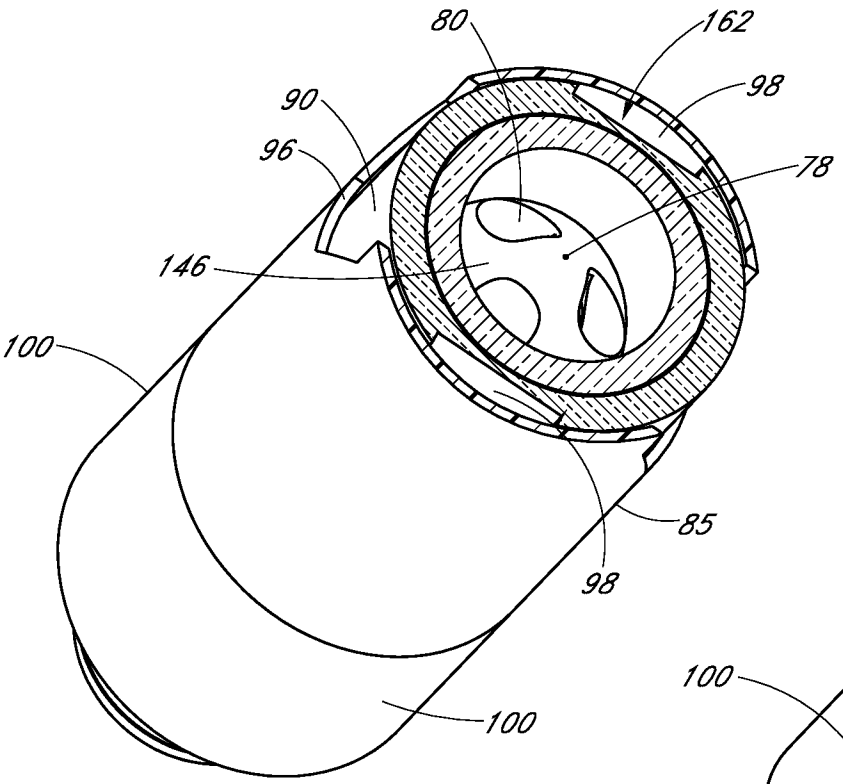
FIG. 15 is a cross-sectional view taken along line 15-15 of FIG. 6.
Figure 18:
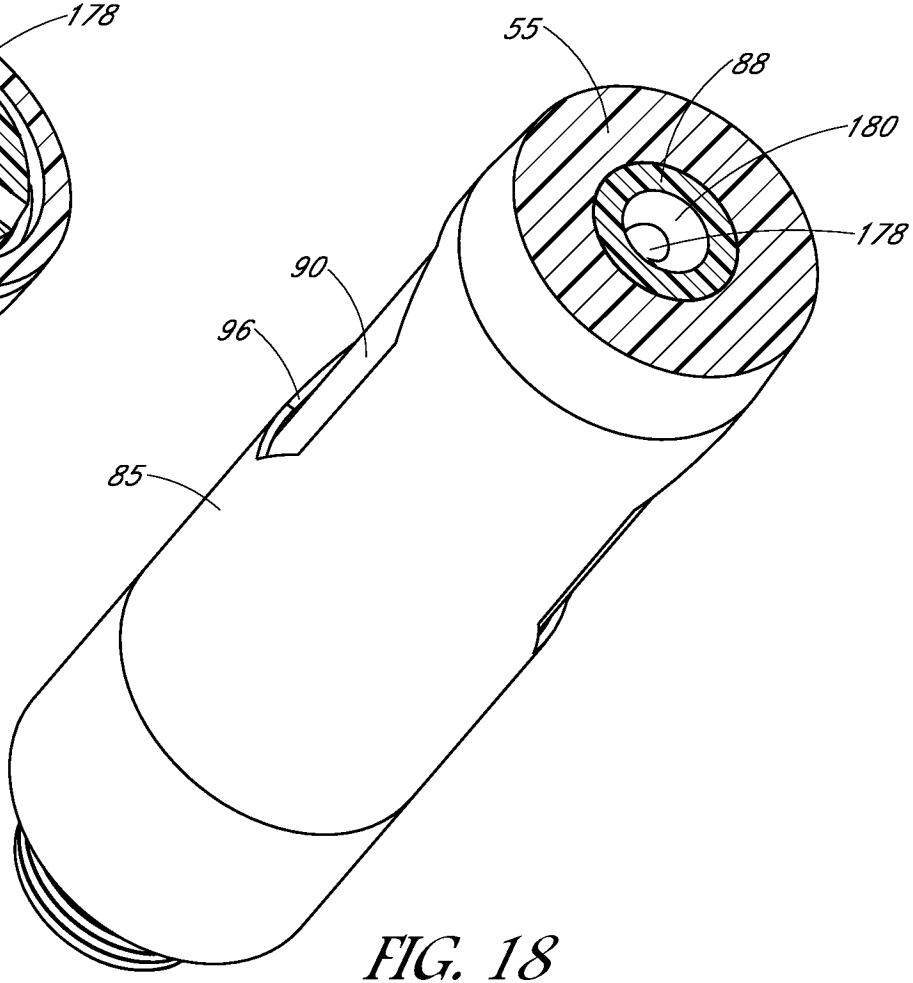
FIG. 18 is a cross-sectional view taken along line 18-18 of FIG. 6.

As discussed above, and with additional reference to FIGS. 14 and 15, the vial receiver 76 comprises a puncture tip 78 at its proximal end. The puncture tip 78 is the proximal-most point of a conical proximal surface 146 through which the plurality of feeder holes 80 are formed. With additional reference to FIGS. 6 and 7, a hollow axial passage 150 is defined within the vial receiver 76 and in communication with the feeder holes 80. The hollow axial passage 150 expands in diameter toward its distal end so as to define a media manifold 152 communicating with the longitudinally extending media passages 140 of the base insert 102. As such, vaporizing media M within the vial 66 can flow through the feeder holes 80 and hollow axial passage 150 into the media manifold 152 and further through the longitudinally extending media passages 140 to the ceramic wick 110.

In the illustrated embodiment, an outer diameter of the vial receiver 76 is configured to approximate the inner diameter of the vial sidewall 67 so that the vial 66 can be slid over the vial receiver 76 but with a snug fit. Further, preferably a sealing structure is provided. In the illustrated embodiment, the sealing structure comprises a pair of O-rings 82 received in O-ring seats formed on the vial receiver 76. The elastomeric O-rings 82 engage the inner surface of the vial sidewall 67 to effectuate a seal. Preferably, the stopper material is chosen so that, after being punctured and the vial 66 being advanced over the vial receiver 76, such stopper material will not interfere or defeat the seal between the O-rings and the vial 66.

Since the vial 66 fits snugly over the vial receiver 76, there is little or no space therebetween through which media M can flow. Also, preferably the feeder holes 80 are configured to be substantially aligned with the base of the conical surface (where the conical surface meets the outer surface of the vial receiver 76) so that substantially all media can flow through the feeder holes 80 and into the hollow axial passage 150 of the vial receiver 76.

The illustrated personal vaporizer 50 is configured so that when a user places their mouth over the mouthpiece and draws a breath while electrically actuating the heating element, which in this embodiment is a heating coil 114, atmospheric air A is drawn into the vaporizing chamber 120, where it is mixed with atomized media M to form a vapor V. The vapor V is drawn out of the vaporizing chamber 120 and travels along a vapor pathway 98 defined within the vaporizer to and through the mouthpiece.

With reference again to FIGS. 8-10, the guide 90 is configured both to snugly hold the vial 66 within its guide lumen 94 and to define vapor paths 98. In the illustrated embodiment, the guide 90 is elongated and tubular, and has a proximal end and a distal end. A distal surface 158 is generally normal to an elongated sidewall 160. A tapered surface 159 can be provided in some embodiments adjacent the distal surface 158 to provide a transition between the inner surface of the sidewall and the distal surface 158 of the guide 90.

A pair of elongated slots 162 are formed in the outer surface of the sidewall 160 on opposing sides. Each slot 162 is defined by a slot surface 164 and a pair of slot side surfaces 166. Each slot 162 has a slot distal surface 168 that is spaced from the distal end of the guide 90 so as to define a vapor entry space 170. Each slot 162 also has a slot proximal surface 169 that is spaced from the proximal end 167 of the guide 90 so as to define a vapor exit space 171

With additional reference to FIGS. 6 and 7, the guide 90 is disposed within the outer sleeve 85 portion between the connector piece 92 and the mouthpiece insert 88 and positioned so that the slots 162 are spaced from the windows 96. The outer surface of the guide sidewall 160 tightly engages the inner surface of the outer sleeve 85. In this manner, the slots 162 cooperate with the outer sleeve 85 to define opposing vapor paths 98. Vapor is confined within the vapor paths 98 and thus is prevented from communicating with the windows 96.

Figure 17:
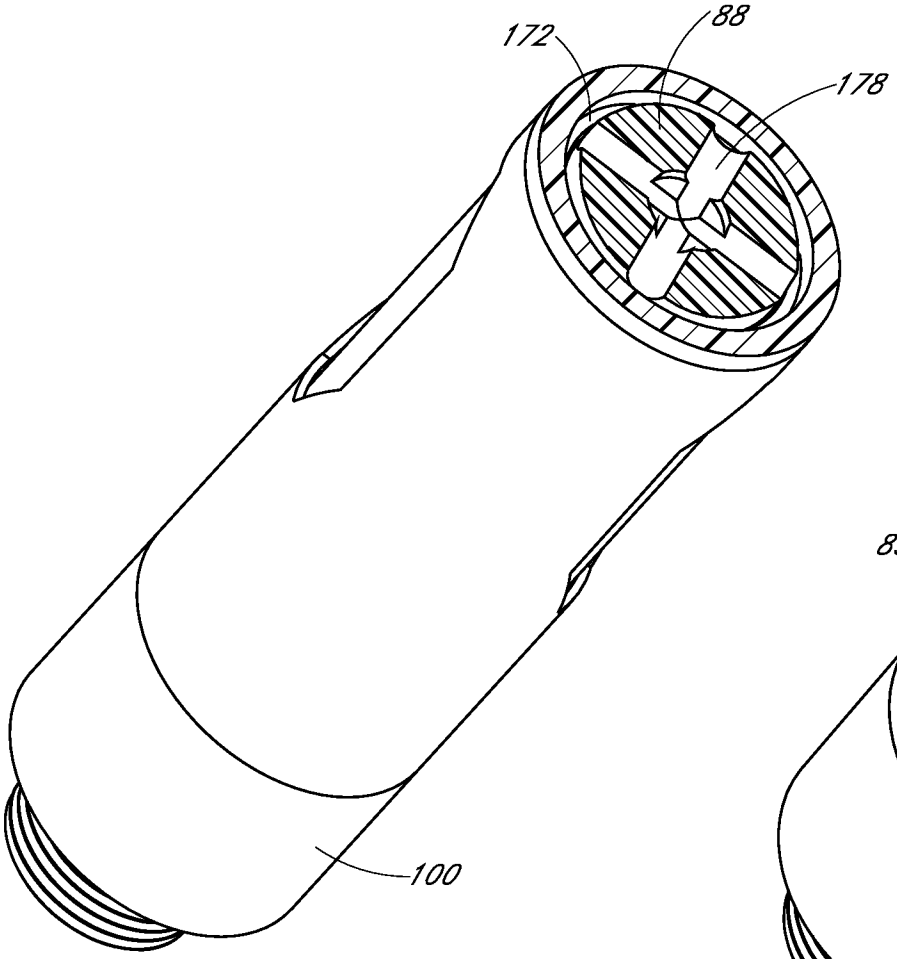
FIG. 17 is a cross-sectional view taken along line 17-17 of FIG. 6.
Figure 19:
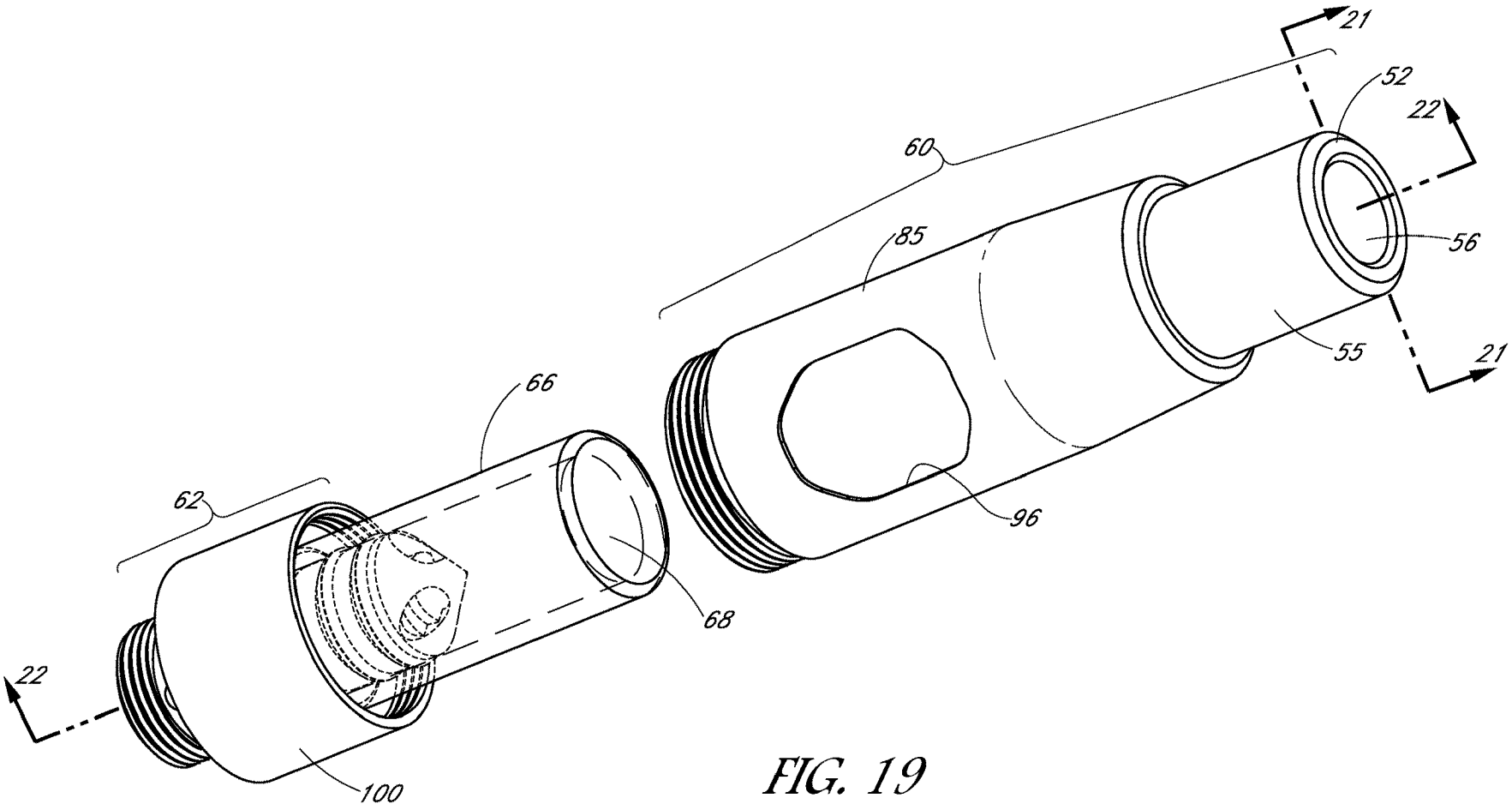
FIG. 19 is a perspective view of another embodiment of a personal vaporizer being assembled over a vial.
Figure 20:
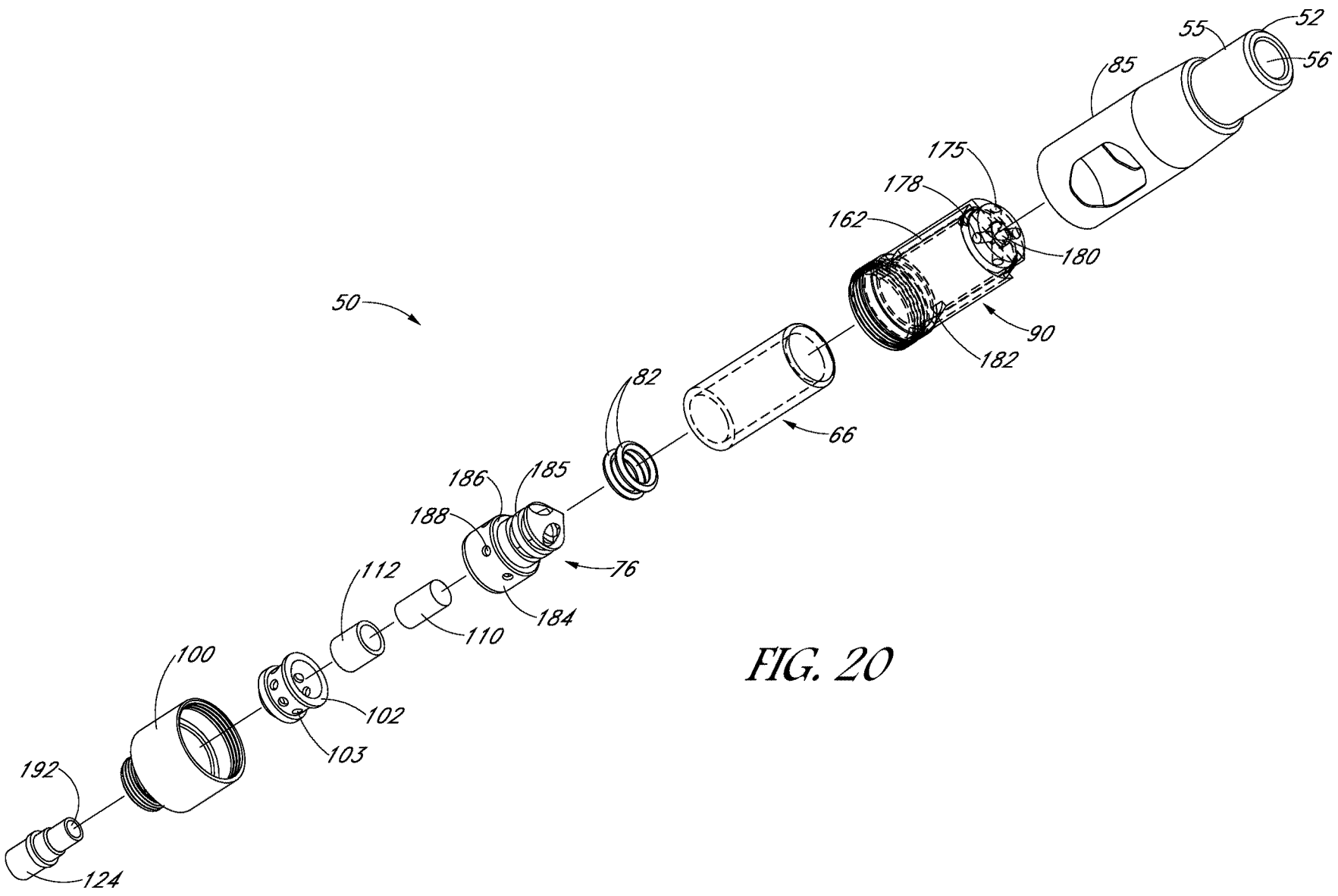
FIG. 20 is an exploded view of the personal vaporizer of FIG. 19.

As discussed above, and with particular reference to FIGS. 6, 7, 11 and 12, vapor V from the vaporizing chamber 120 is drawn into the vapor collector 134, and then flows through the radially extending vapor tubes 136 and into the distal vapor manifold 138. In the illustrated embodiment the distal vapor manifold 138 is radially spaced from the vaporizer's longitudinal axis and extends circumferentially about the base insert 102 between the threaded connection and the distal end of the guide 90. From the distal vapor manifold 138, vapor can flow through the vapor entry spaces 170 into the vapor paths 98 of the guide 90, through which it flows longitudinally past the vial 66 (see also FIGS. 13-16) to and through the vapor exit spaces 171 and into a proximal vapor manifold 172 defined adjacent and circumferentially surrounding the mouthpiece insert 88 (see FIG. 17). The illustrated proximal vapor manifold 172 is also radially spaced from the longitudinal axis of the vaporizer 50.

With particular reference to FIGS. 6, 7, 17 and 18, vapor within the proximal vapor manifold 172 is directed through radially directed vapor passages 178 of the mouthpiece insert 88 to an axially directed vapor path 180 and further to and through the axially placed mouthpiece opening 56.

As shown and discussed, intake air A is thus first directed along an axis of the device 50 to the vaporizing chamber 120, from which vapor V is directed radially outwardly and then directed longitudinally around the vial 66 but spaced from the windows 96 while radially spaced from the axis. The vapor is then directed radially inwardly so as to again flow along the longitudinal axis of the vaporizer 50 to and through the axially aligned mouthpiece opening 56.

In the illustrated embodiment, the guide 90 is formed of a transparent material such as a plastic or glass. It is to be understood, however, that the guide 90 can be formed of other materials and can be opaque if desired. Further the illustrated guide 90 did not include a window, but instead relied upon its transparent nature to allow the user to observe the vial 66 held therewithin. In additional embodiments, the guide 90 can also comprise a window aperture configured to align with the window of the outer sleeve 85. In further embodiments, the guide 90 can be formed with both transparent and opaque portions and the device can be configured so that the guide 90 is positioned with its transparent portions aligned with the window of the outer sleeve 85.

In the illustrated embodiment the vapor paths 98 are defined by the guide slots and the outer sleeve 85. In additional embodiments the guide 90 may include elongated, longitudinal holes that define the vapor paths 98 independent of the outer sleeve 85.

In the illustrated embodiment, the guide lumen 94 has a length greater than a length of the vial 66. As such, the guide lumen 94 substantially prevents vapor from contacting the vial 66. As the vapor may be expected to leave at least some deposits on surfaces over which it flows, preventing the vapor from contacting the vial 66 will keep the outer surface of the vial 66 from having such deposits on it when the vial 66 is eventually removed from the vaporizer 50 after use. In other embodiments, however, such deposits are may not be an important concern, and the guide 90 can be configured so that at least a portion of the vapor paths 98 pass across a portion of the vial outer surface.

With reference next to FIGS. 19-22, another embodiment of a personal vaporizer 50 for use with a separately formed and selectively removable vial 66 is illustrated. In the illustrated embodiment, the guide 90 is unitarily formed and comprises distal external threads configured to threadingly engage proximal internal threads formed on the base 100 so as to selectively connect the proximal portion 60 to the distal portion 62. The illustrated guide 90 also includes a transition zone 175 at its proximal end, which transition zone 175 includes radially extending vapor passages 178 aligned with an axially extending mouthpiece vapor passage 180. Further, a pair of vapor entry apertures 182 are formed through the guide 90, with one vapor entry aperture aligned with a distal end of each slot 162. In the illustrated embodiment, the vapor entry apertures 182 are proximal of the distal external threads.

In the illustrated embodiment, the vial support/receiver 76 comprises a distally extending portion 184 that fits within the base 100, preferably in a press-fit manner. The distally-extending portion 184 has a greater diameter than the vial receiver portion 185, and a seat surface 186 is defined therebetween. A plurality of apertures 188 are formed spaced circumferentially around the distally-extending portion 184. A base insert 102 is received within the distally extending portion 184. The conductive pin 124 extends through the battery mount of the base 100 and into the base insert 102. In the illustrated embodiment, the base insert 102 is formed of an electrically insulative material configured and positioned to electrically insulate the conductive pin 124 from the base 100.

The illustrated vial receiver 76 again defines a conical surface 146 with a puncture tip 78 and feeder holes 80 opening into an elongated body. However, in the illustrated embodiment the wick receiver 104 is defined within the body, and a ceramic wick 110 and surrounding cotton gasket 112 are received therewithin. The illustrated ceramic wick 110 is open at its distal end and defines an elongated tubular vaporizing chamber 120 aligned with its axis. The vaporizing chamber 120 terminates at an end wall 190 at the proximal end of the ceramic wick 110. In the illustrated embodiment, the proximal end of the ceramic wick 110 is disposed proximal of the distalmost portion of the feeder holes 80. As such, in the illustrated embodiment, very little media flow is required in order to place the media in contact with the porous ceramic wick 110. This embodiment, then, is particularly advantageous for use with high-viscosity media such as some concentrated cannabidiol distillates. Additionally, as shown, the ceramic wick 110, which includes the heating coil 114, is disposed within the media tank 70 of the vial 66 when the vial is installed over the vial receiver 76. This minimizes the length of any media flow path to the heating element. Still further, preferably the vial receiver 76 is formed of a metal material configured so that some of the heat generated in the ceramic wick 110 is transferred to the vial receiver 76, which in turn transfers some heat to the media M, helping to reduce the media's viscosity and improve media flow properties. Preferably, such heat transferred by the vial receiver 76 is sufficient to lower media viscosity so as to improve media flow, but insufficient to atomize any of the media.

Figure 21:
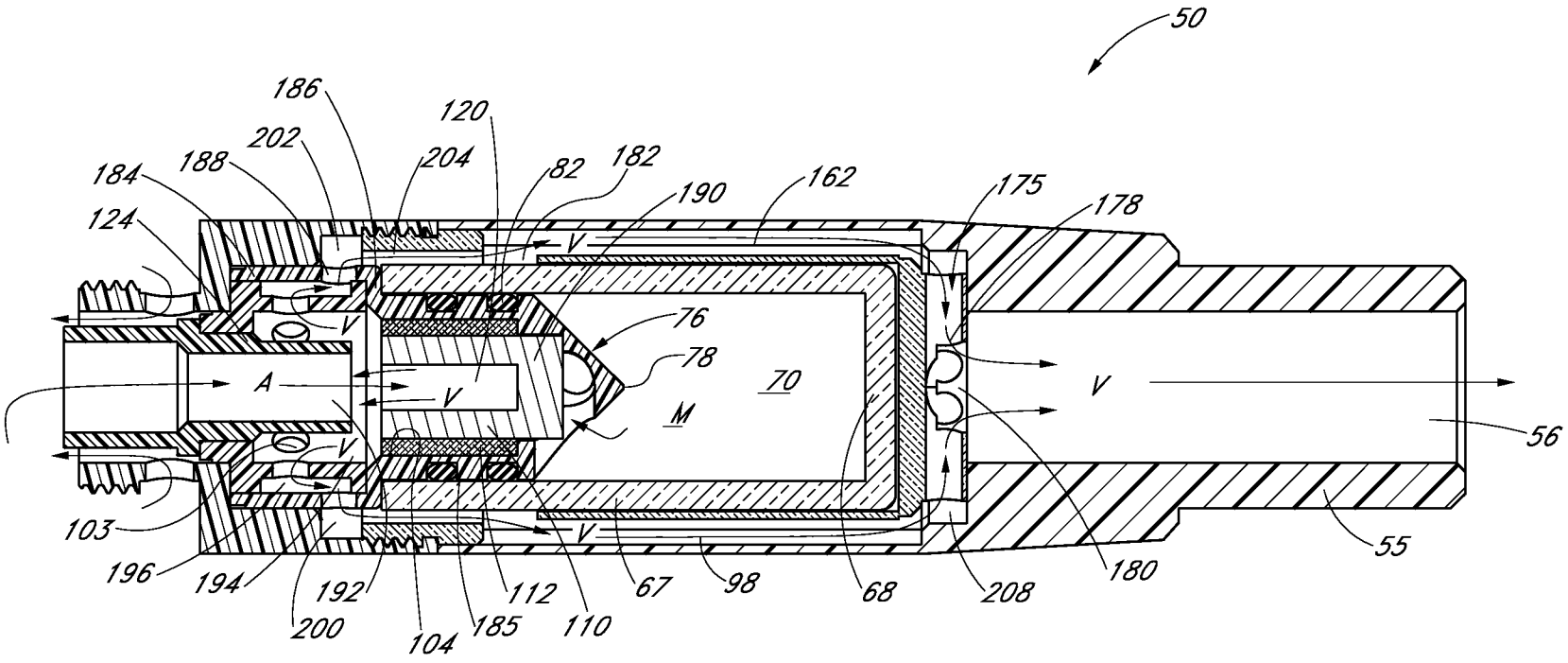
FIG. 21 is a cross-sectional view taken along line 21-21 of FIG. 19.
Figure 22:
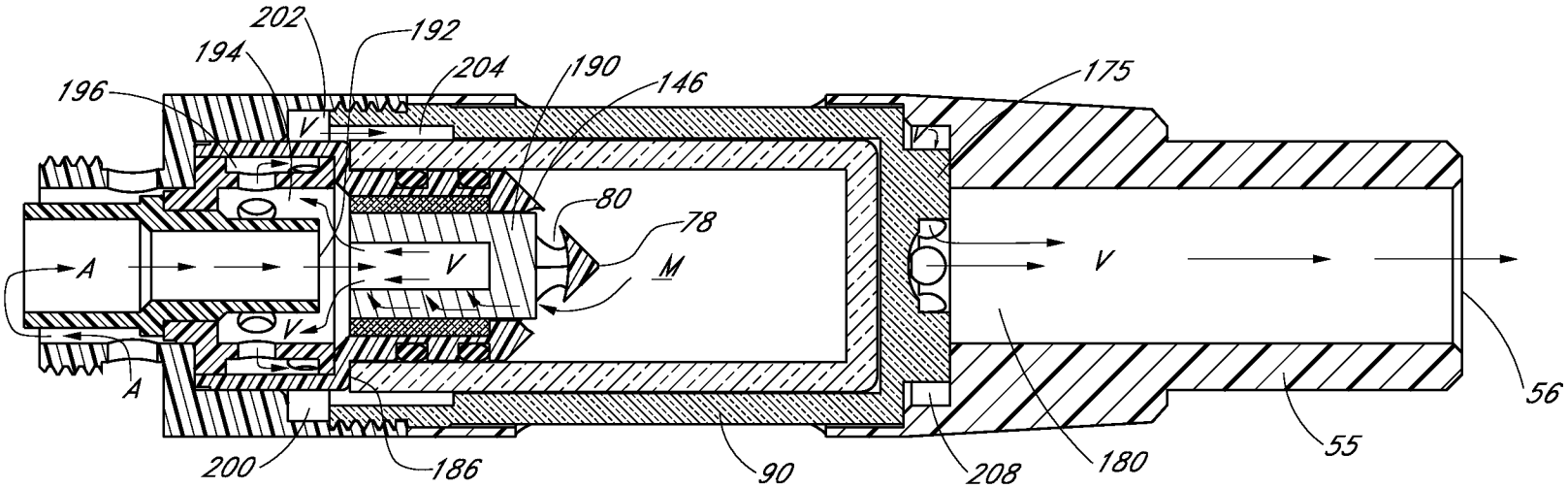
FIG. 22 is a cross-sectional view taken along line 22-22 of FIG. 19.
Figure 23:
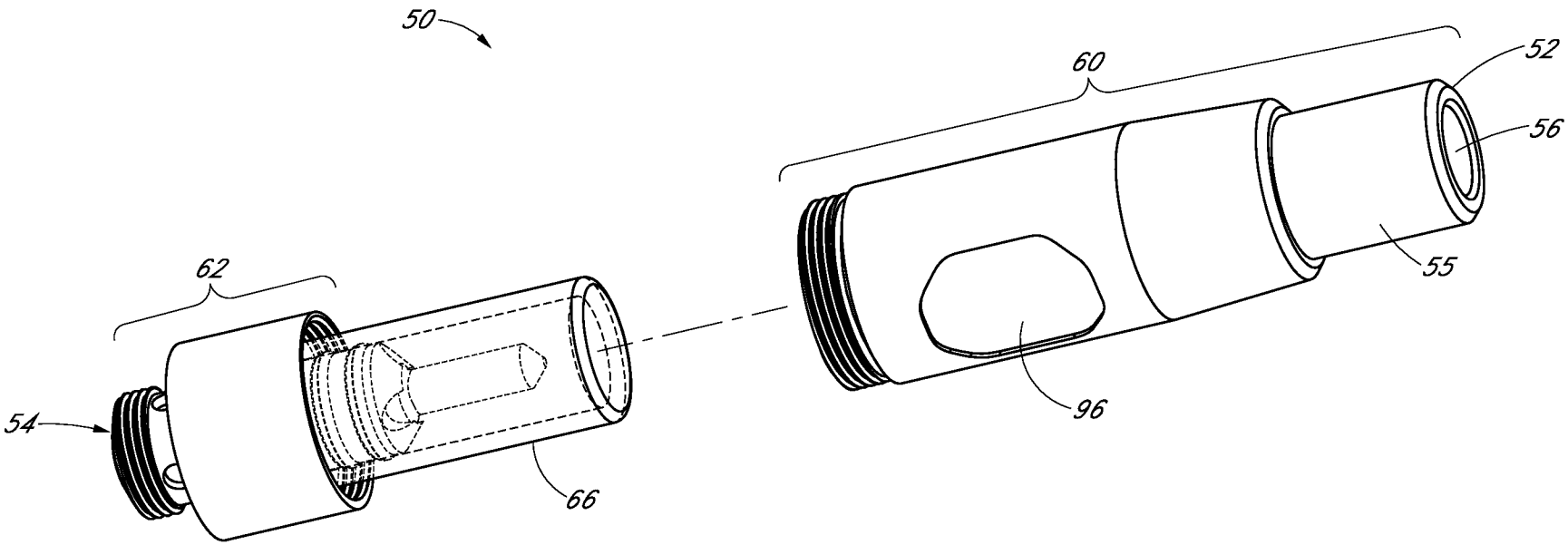
FIG. 23 is a perspective view of yet another embodiment of a personal vaporizer being assembled over a vial.
Figure 24:
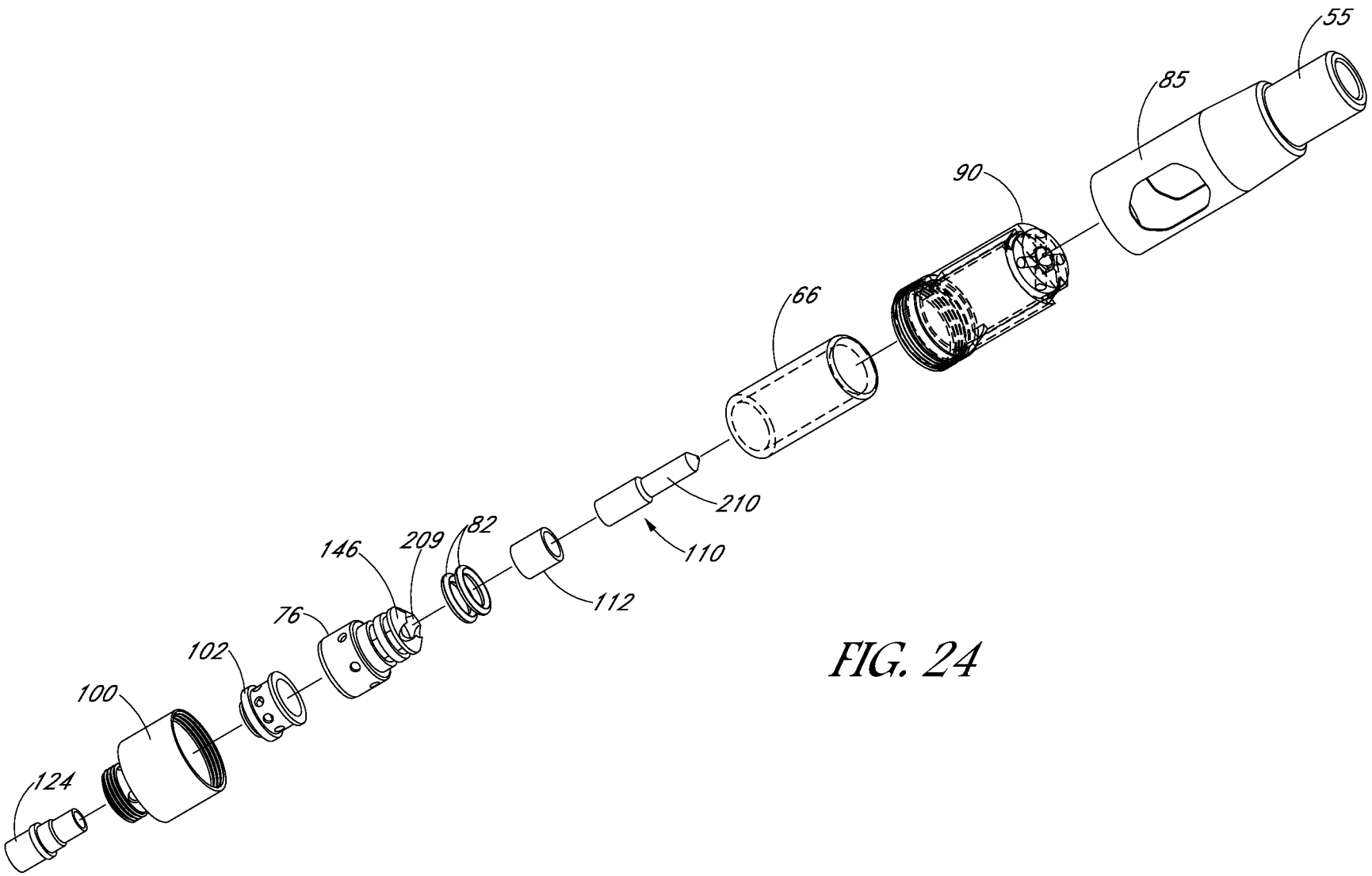
FIG. 24 is an exploded view of the personal vaporizer of FIG. 23.
Figure 25:
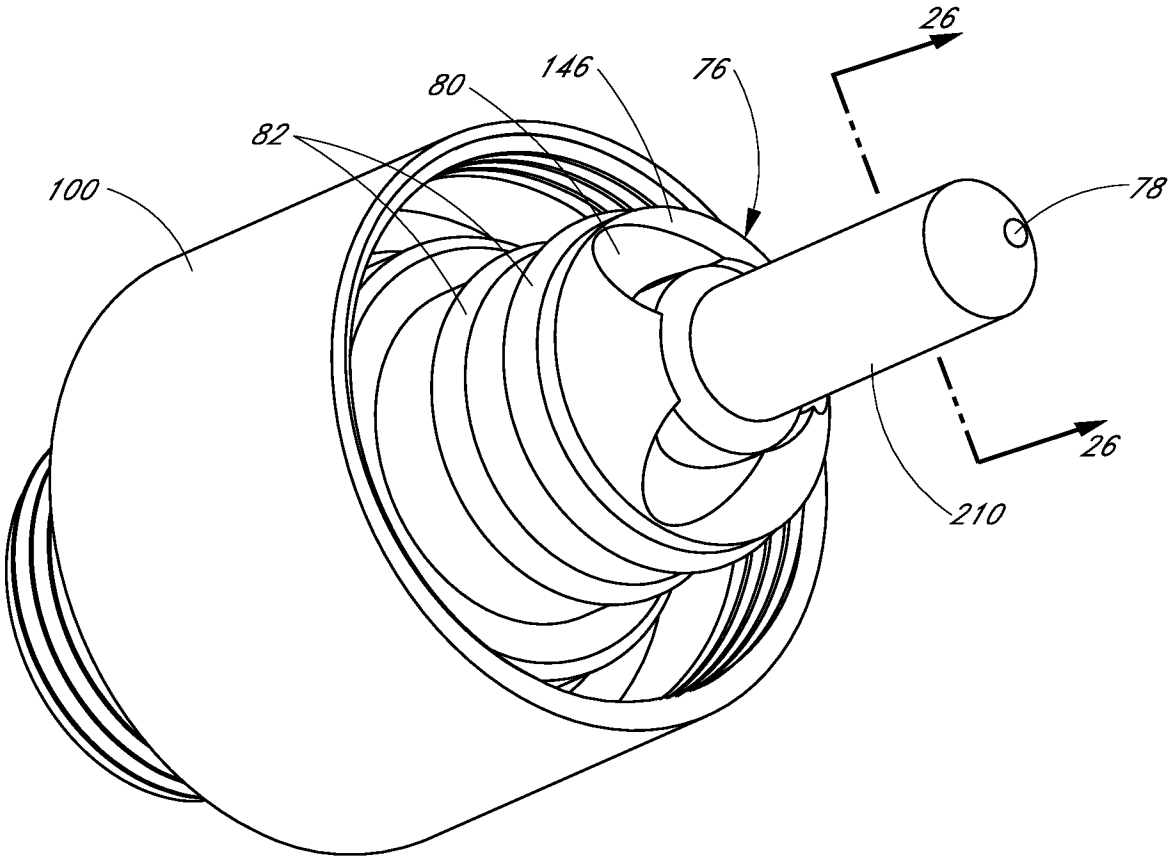
FIG. 25 is a perspective view of a base portion of the personal vaporizer of FIG. 23.
Figure 26:
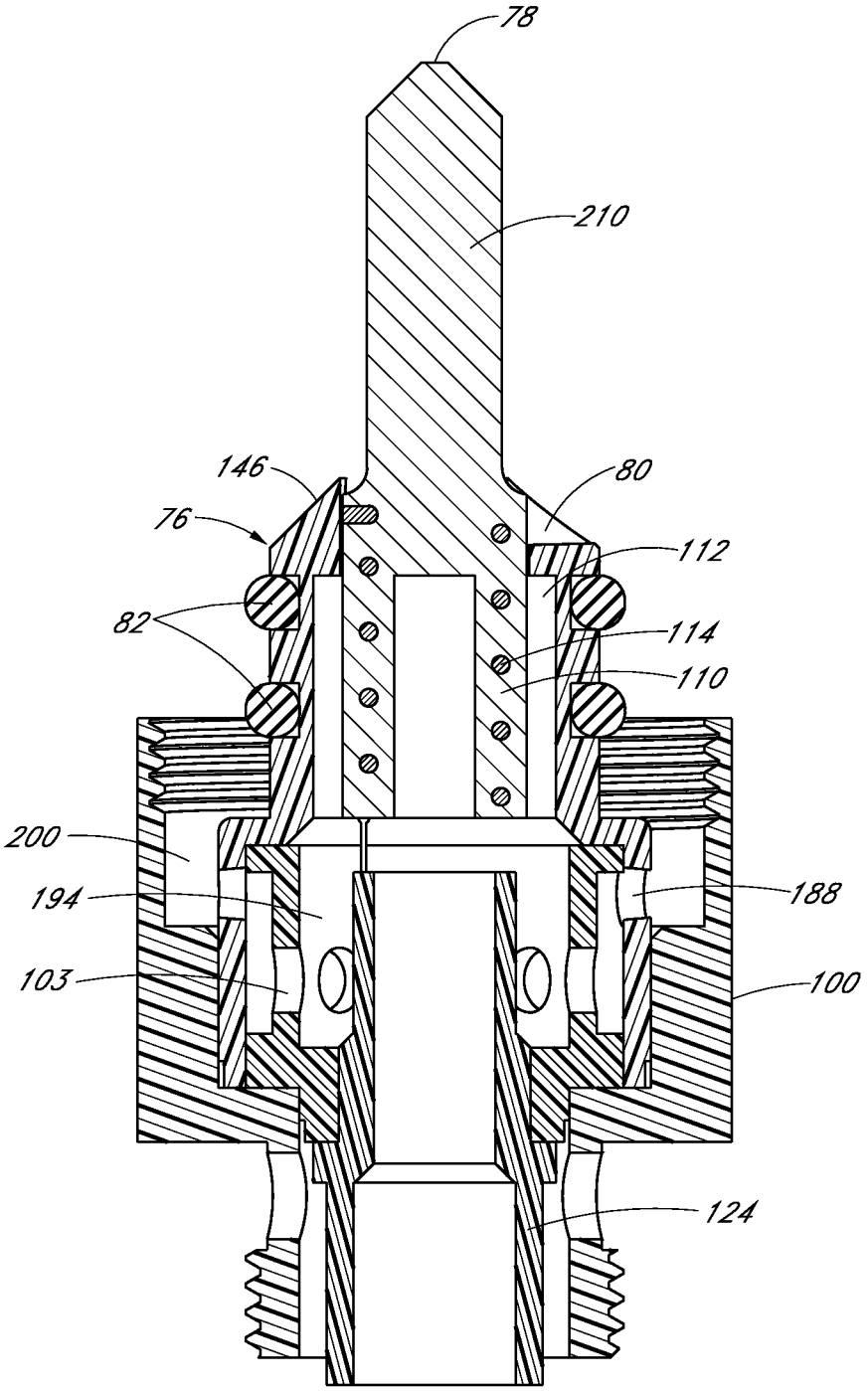
FIG. 26 is a cross-sectional view taken along line 26-26 of FIG. 25.

As best shown in FIGS. 21 and 22, the conductive pin 124 preferably is tubular and axially aligned with the axial vaporizing chamber 120. During use, environmental air A is drawn through the intake air holes 122 and into the conductive pin 124 and directed by the conductive pin 124 axially through the pin's proximal opening 192 and into the vaporizing chamber 120. Preferably, a diameter of the conductive pin 124 reduces along its length so that the intake air is accelerated. The air A is directed into the vaporizing chamber 120, where it is mixed with atomized media M to form a vapor V. The vapor V will work its way distally out of the vaporizing chamber 120. As shown, then, air A and vapor V will change flow direction by at least 180° within the vaporizing chamber 120. Also, since intake air is being directed into the vaporizing chamber 120 while vapor simultaneously is being drawn out of the vaporizing chamber 120, a turbulent environment is created, leading to the air A absorbing an increased volume of atomized media M so as to form a higher quality vapor.

In the illustrated embodiment, the proximal opening 192 of the conductive pin 124 is positioned just distal of the distal opening of the vaporizing chamber 120. Also, the inner diameter of the proximal opening 192 of the conductive pin 124 is slightly larger than the diameter of the distal opening of the vaporizing chamber 120. In another embodiment, the diameter of the pin's proximal opening 192 can be less than that of the vaporizing chamber 120. In yet additional embodiments the conductive pin 124 can be placed so that it extends a distance into the vaporizing chamber 120, and the proximal opening 192 is thus positioned within the vaporizing chamber 120 proximal of the distal end of the ceramic wick 110.

Continuing with reference to FIGS. 21-22, vapor V works its way out of the vaporizing chamber 120 and into a vapor space 194 defined distal of the ceramic wick 110 and between the hollow conductive pin 124 and the base insert 102. Such vapor will flow through a plurality of base insert apertures 103 into a secondary vapor space 196 defined between the base insert 102 and the distal portion 184 of the vial receiver 76. From the secondary vapor space 196, vapor will flow through the apertures 188 in the distal portion 184 of the vial receiver 76 to a distal manifold 200 that is radially spaced from the axis of the vaporizer 50. The illustrated distal manifold 200 is elongated. A distal portion 202 is defined between the distal part 184 of the vial receiver 76 and the base 100. A proximal portion 204 of the distal manifold 200 is defined between the distal portion of the guide 90 and the vial 66. From the distal manifold 200, vapor flows through the vapor entry apertures 182 into the vapor passage 98 and longitudinally past the vial 66 to a proximal vapor manifold 208 that is also radially spaced from the axis of the vaporizer, but which is in communication with the proximal transition zone 175 of the guide 90. The proximal transition zone 175 includes radially directed passages 178 that direct the vapor to an axially directed mouthpiece passage 180, from which the vapor V flows out of the mouthpiece opening 56.

With reference next to FIGS. 23-26, in another embodiment, the conical proximal surface 146 of the vial support 76 does not include a puncture tip, but instead comprises a proximal opening 209. A proximally extending portion 210 (or "spear") of the ceramic wick 110 extends through the proximal opening 209 of the vial support 76. In the illustrated embodiment, the proximally extending portion 210 of the ceramic wick 110 is not hollow and thus the vaporizing chamber 120 does not extend into the proximally extending portion 210. And preferably the ceramic wick 110 retains the proximal end wall 190 terminating the vaporizing chamber 120 distal of the base of the spear 210. Preferably, however, at its proximal end the spear comprises a puncture tip 78 configured to puncture the stopper 74 of the vial 66.

In a preferred embodiment, although a heating coil 114 is embedded within the ceramic wick 110, preferably the heating coil 114 is limited to a main body portion of the ceramic wick 110 (distal of the spear). As such, although the distal portion of the ceramic wick 110 is heated sufficient to atomize media, the proximally-extending spear portion 210 is not heated sufficient to atomize media. In the illustrated embodiment the spear 210 is unitarily formed as part of the ceramic wick 110, and a portion of heat from the heating coil 114 will be transferred from the main body to the spear 210. Preferably, such heat within the spear is sufficient to melt solid media such as waxes and crystalized media in order to decrease the media viscosity and facilitate (or even enable) the media to flow distally within the vial 66 (or within the porous ceramic spear) into the main body of the ceramic wick 110, where it will be atomized. Preferably, however, heat in the spear 210 is not sufficient to atomize the media within the media tank 70. As such, the present embodiment is particularly advantageous for high viscosity liquids and solid vaporizing media. Of course, it can still be used with low-viscosity liquids as well.

In an additional embodiment, the heating coil 114 can be extended into the spear 210, but preferably the coil wrapping density is reduced relative to the portion in the vaporizing chamber 120 so as to warm, but not atomize, the media. In yet another embodiment, a separate heating coil can extend into the proximally extending portion 210 of the ceramic wick 110. The separate heating coil preferably is configured to impart less heat to the proximally extending wick than does the primary heating coil 114. To wit, a secondary heating coil is selected to impart enough heat to decrease media viscosity without atomizing such media. In still another embodiment, a conductive element such as a metal rod can be disposed within the proximally extending portion so as to passively communicate heat from the vaporizing chamber 120 portion of the ceramic wick 110. In a still further embodiment, rather than the proximally extending portion 210 being part of the ceramic wick 110, it can be a metal or other communicative material attached to the ceramic wick 110 and extending proximally therefrom. Also, it is to be understood that, in other embodiments, the spear can have various shapes and configuration, such as tapering continuously until reaching the proximal puncture tip 78.

Figure 27:
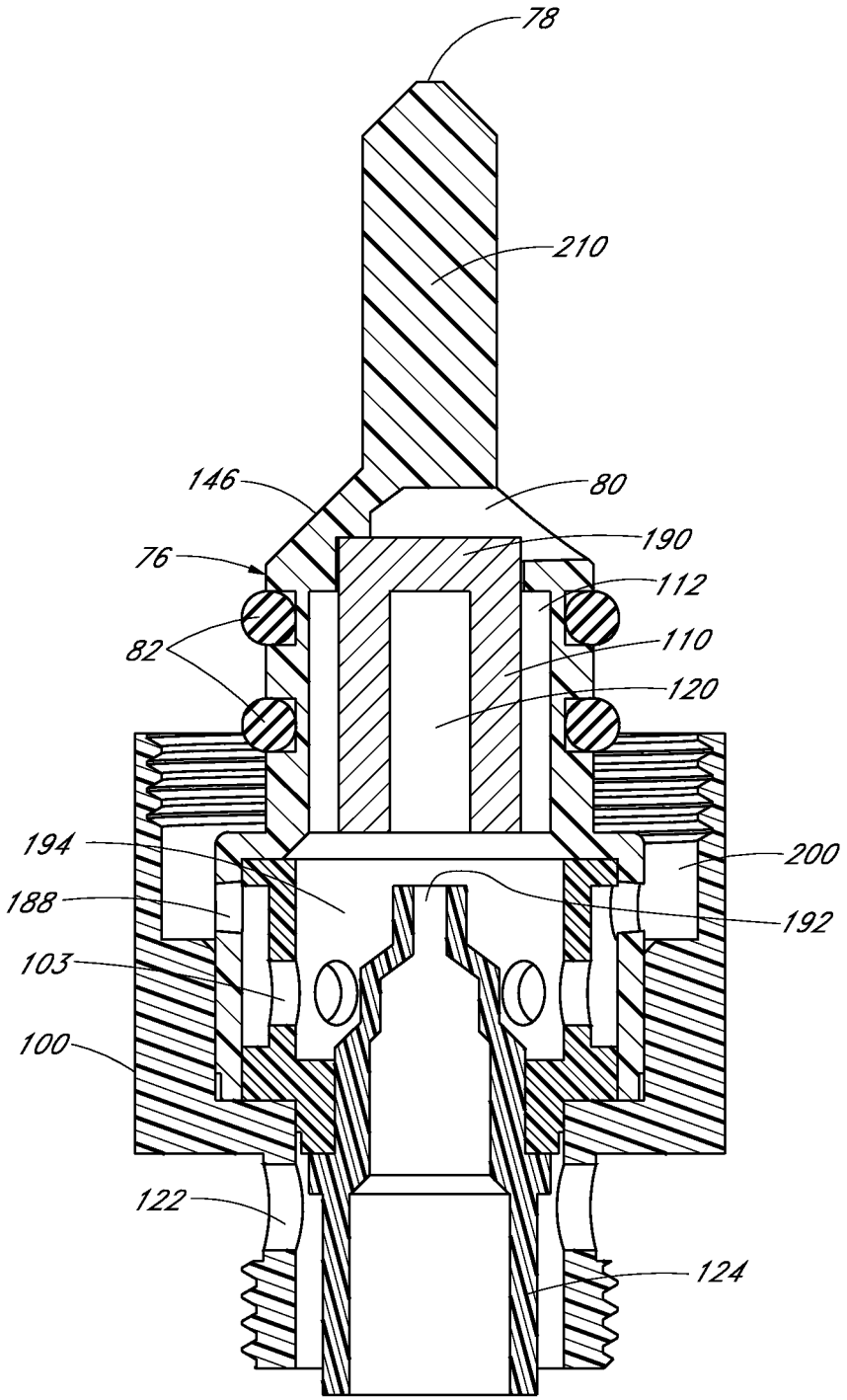
FIG. 27 shows another embodiment of a base portion of a personal vaporizer.

With reference next to FIG. 27, in still another embodiment, the spear 210 can be part of the vial receiver 76 rather than the ceramic wick 110. In such an embodiment, the spear 210 can extend proximally from the conical surface 146. Additionally, in the illustrated embodiment the conductive pin 124 is configured to narrow along its length so that air flowing therethrough may be accelerated. Also, the illustrated proximal opening 192 has a diameter less than the diameter of the vaporizing chamber 120. In a still further embodiment the conductive pin 124 can be configured so that the pin proximal opening 192 is positioned proximal of the distal-most end of the ceramic wick 110, opening within the vaporizing chamber 120.

Figure 28:
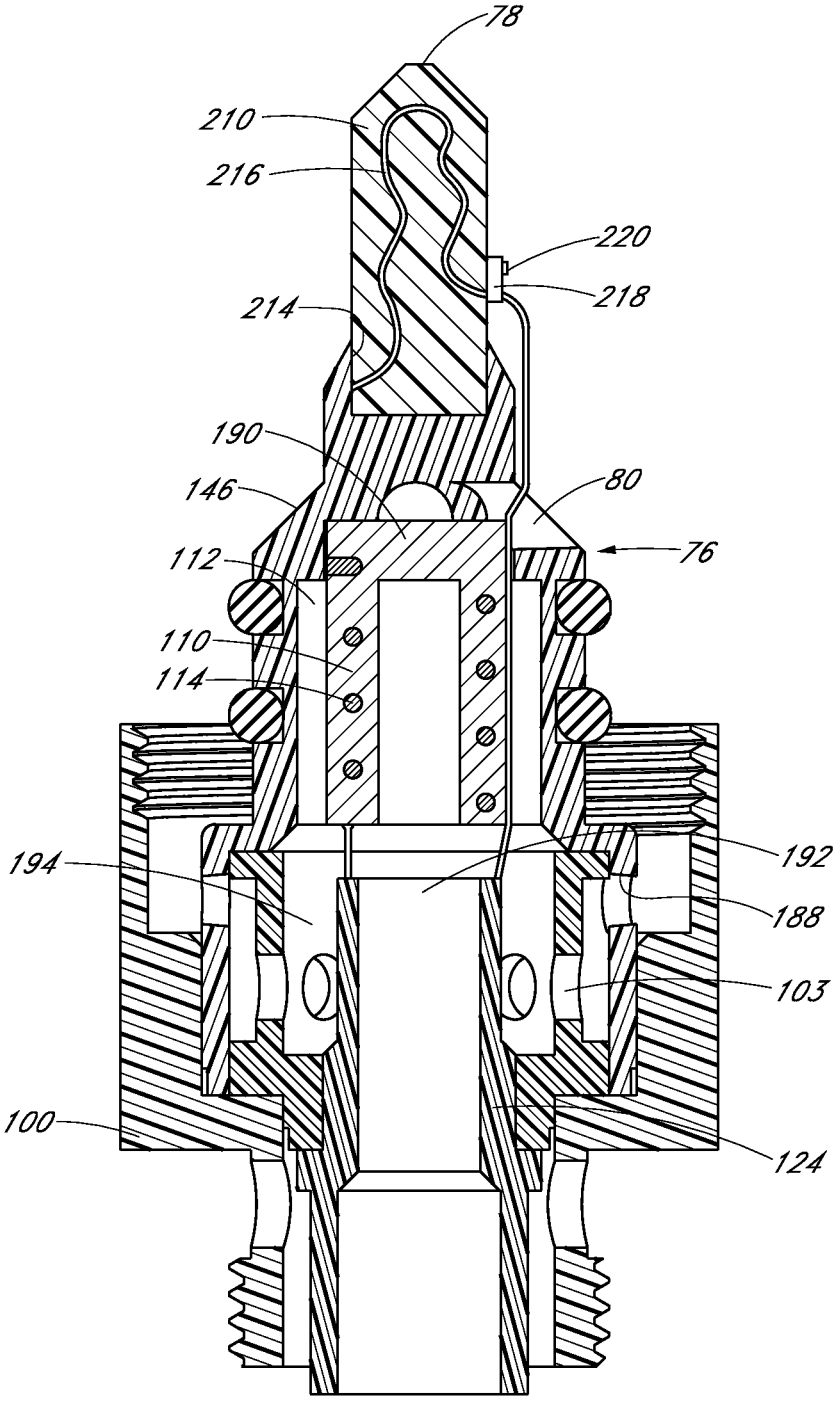
FIG. 28 shows yet another embodiment of a base portion of a personal vaporizer.

FIG. 28 illustrates yet another embodiment in which the vial receiver 76 defines a spear seat 214, and a separately-formed spear 210 extends therefrom. In the illustrated embodiment, the spear 210 comprises a secondary heating element 216 configured to warm the spear 210, and thus warm the surrounding vaporizing media M. The illustrated secondary heating element 216 draws power from the battery, but is configured to operate separately from and independent of the heating element (heating coil 114) of the vaporizing chamber 120. In fact, the illustrated embodiment includes a controller 218 having a sensor 220 configured to sense conditions, such as temperature, of the media within the media tank 70, and to control operation of the secondary heating element 216 accordingly. As such, the secondary heating element 216 can be controlled to maintain the media within the media tank 70 at an optimum temperature for flowing to and through the ceramic wick 110.

In a preferred embodiment, the proximally extending portion, or spear 210, is configured to reach substantially into the tank 70 of the vial 66, preferably extending proximally so that its tip 78 is positioned more than half of the length of the vial tank 70 from the opening; more preferably, greater than two thirds of the length: and most preferably at least three quarters of the length of the vial tank 70 from the opening 72.

Figure 29:
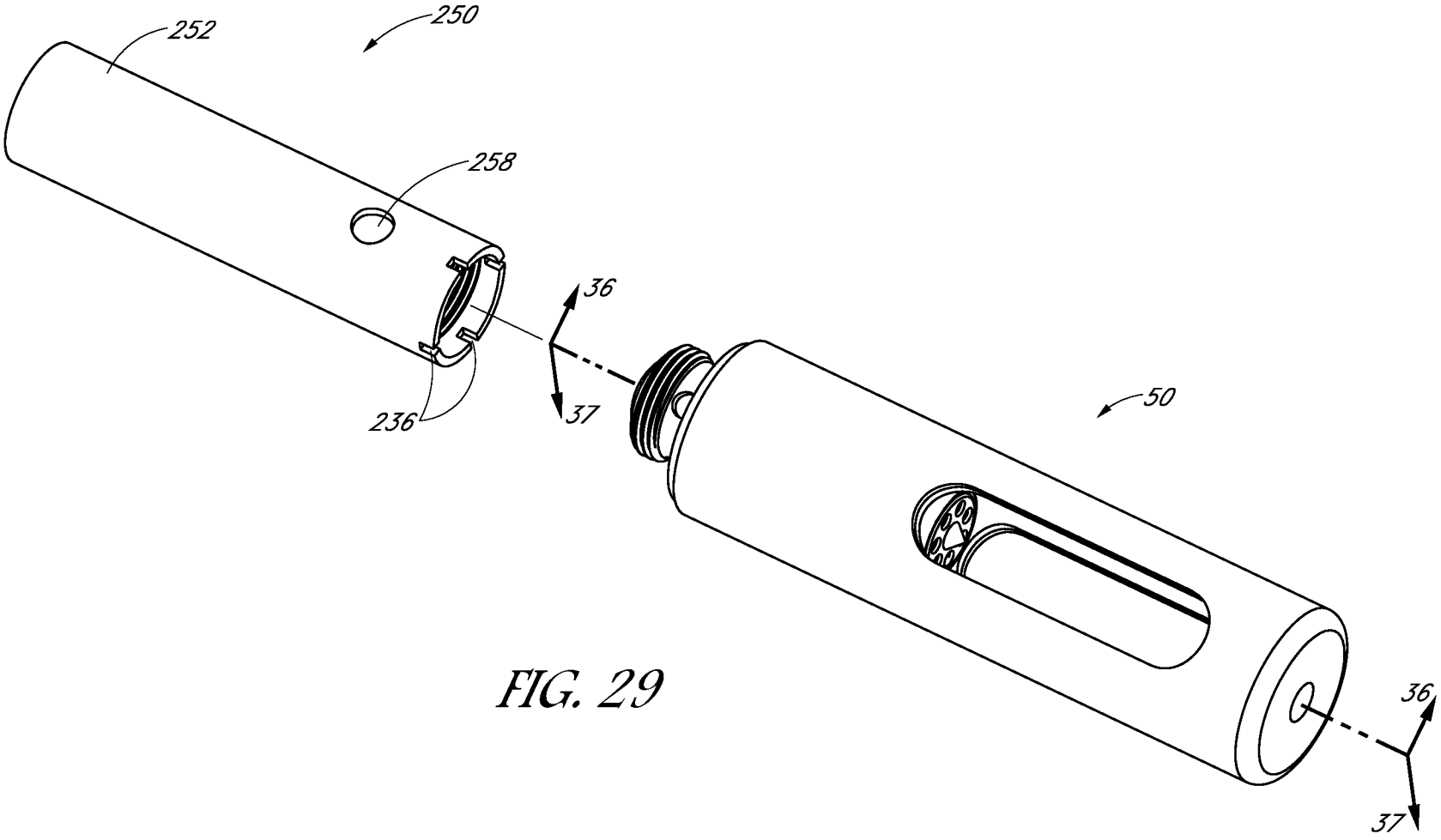
FIG. 29 is a perspective view of still another personal vaporizer.

With reference next to FIG. 29, another embodiment of a personal vaporizer 50 is depicted along with a battery assembly 250. The illustrated battery assembly 250 comprises an elongated casing 252 configured to enclose a battery such as a rechargeable lithium-ion cell. A proximal end of the battery casing 252 comprises a plurality of air slots 236 and a threaded portion configured to threadingly engage the battery mount 58 of the personal vaporizer 50 so as to physically and electrically connect poles of the battery to the vaporizer. A button 258 can be provided to actuate and control power delivery from the battery to the vaporizer 50. It is to be understood that a battery assembly 250 can similarly be releasably attached to other vaporizer embodiments discussed herein.

With additional reference to FIGS. 30-37, the illustrated personal vaporizer 50 comprises a proximal portion 60 and a distal portion 62 that are releasably connected to one another and configured to sandwich a media vial 66 therebetween.

Figure 33:
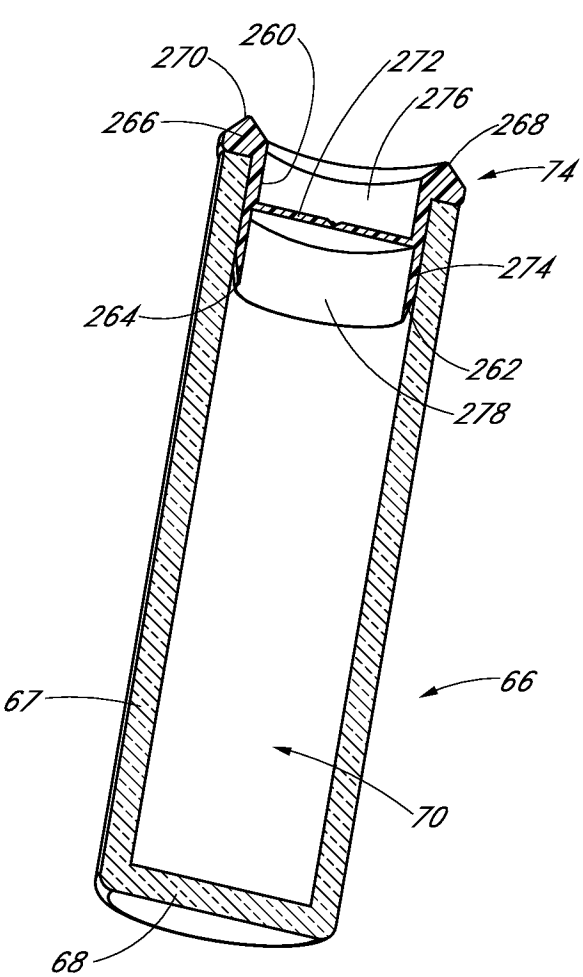
FIG. 33 is a cross-sectional view taken along line 33-33 of FIG. 32.
Figure 32:
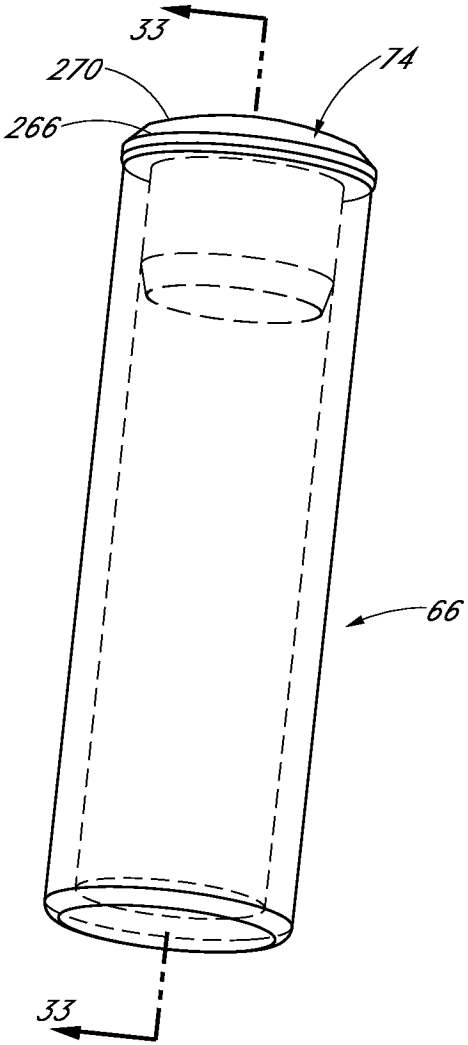
FIG. 32 is a side view of the vial of FIG. 31.
Figure 31:
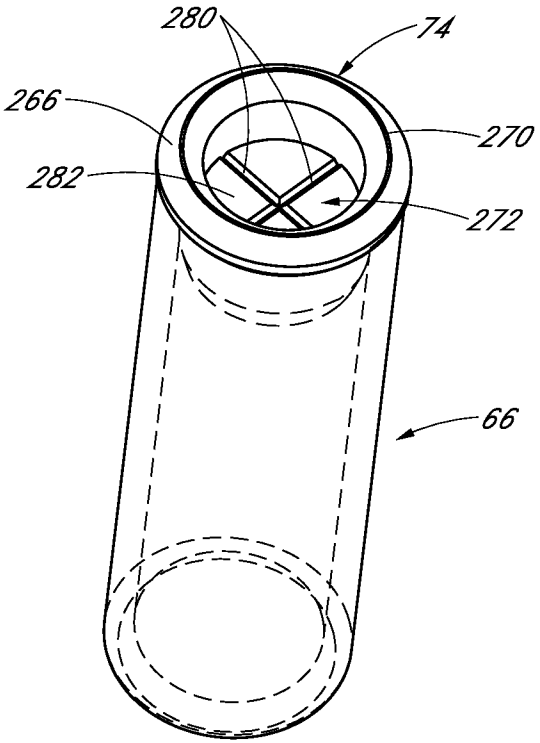
FIG. 31 is a perspective view of another embodiment of a vial.

With specific reference to FIGS. 31-33, in the illustrated embodiment, the media vial 66 comprises a vial closure 74 at its open end 72. The vial closure 74 comprises an elongated tubular body 260 configured to extend into and through the vial's open end 72 so as to sealingly engage the inner surface of the vial 66. A tapered surface 262 can be provided at an inserted end 264 of the body. A flange 266 extends radially outwardly adjacent the opening end 268 of the body, and is configured to engage the vial side wall 67 at the open end 72, preferably so as to create a seal and also prevent the body 260 from being drawn further into the vial 66. A resilient rim 270 extends from the flange 266. A valve 272 extends transversely across the tubular body 260. When the closure 74 is in place, vaporizing media M within the media tank 70 is blocked by the valve 272 from exiting the media tank 70. Also, preferably the closure 74 establishes an airtight seal.

With particular reference to FIGS. 31-33, preferably the valve 272 is positioned between the opening end 268 and inserted end 264 of the body 260. A skirt portion 274 of the body 260 extends from the valve 272 to the inserted end 264. Preferably the thickness of the body 260 in the skirt portion 274 is reduced by an amount similar to the thickness of the valve 272. An opening cavity 276 is defined within the body 260 between the opening end 268 and the valve 272. A skirt cavity 278 is defined within the body 260 between the valve 272 and the inserted end 264. In the illustrated embodiment scores 280 are formed in the valve 272, with individual valve flaps 282 defined between the scores 280.

Figure 34:
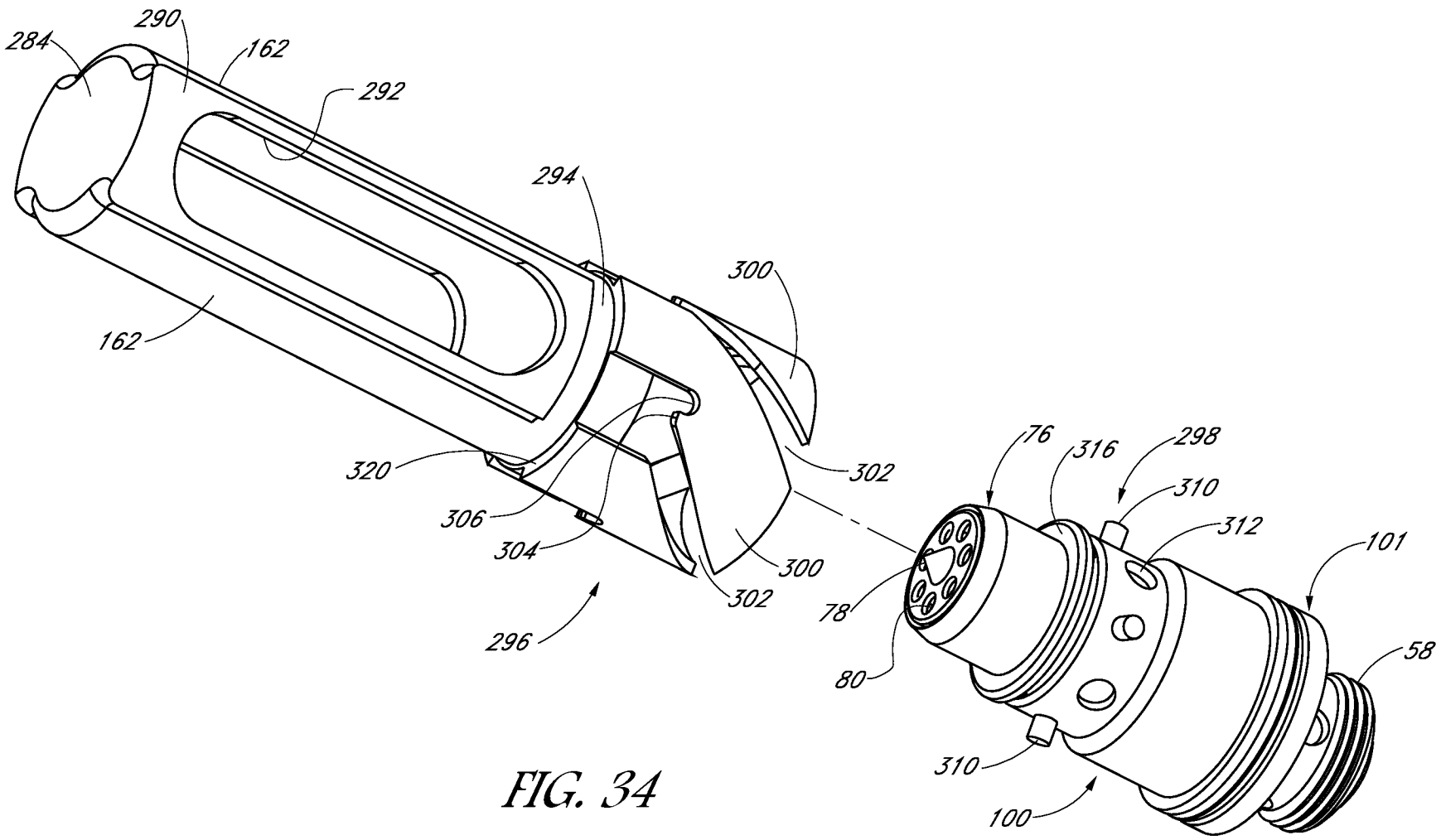
FIG. 34 is a partially exploded view of the personal vaporizer of FIG. 29 with a sleeve removed.
Figure 35:
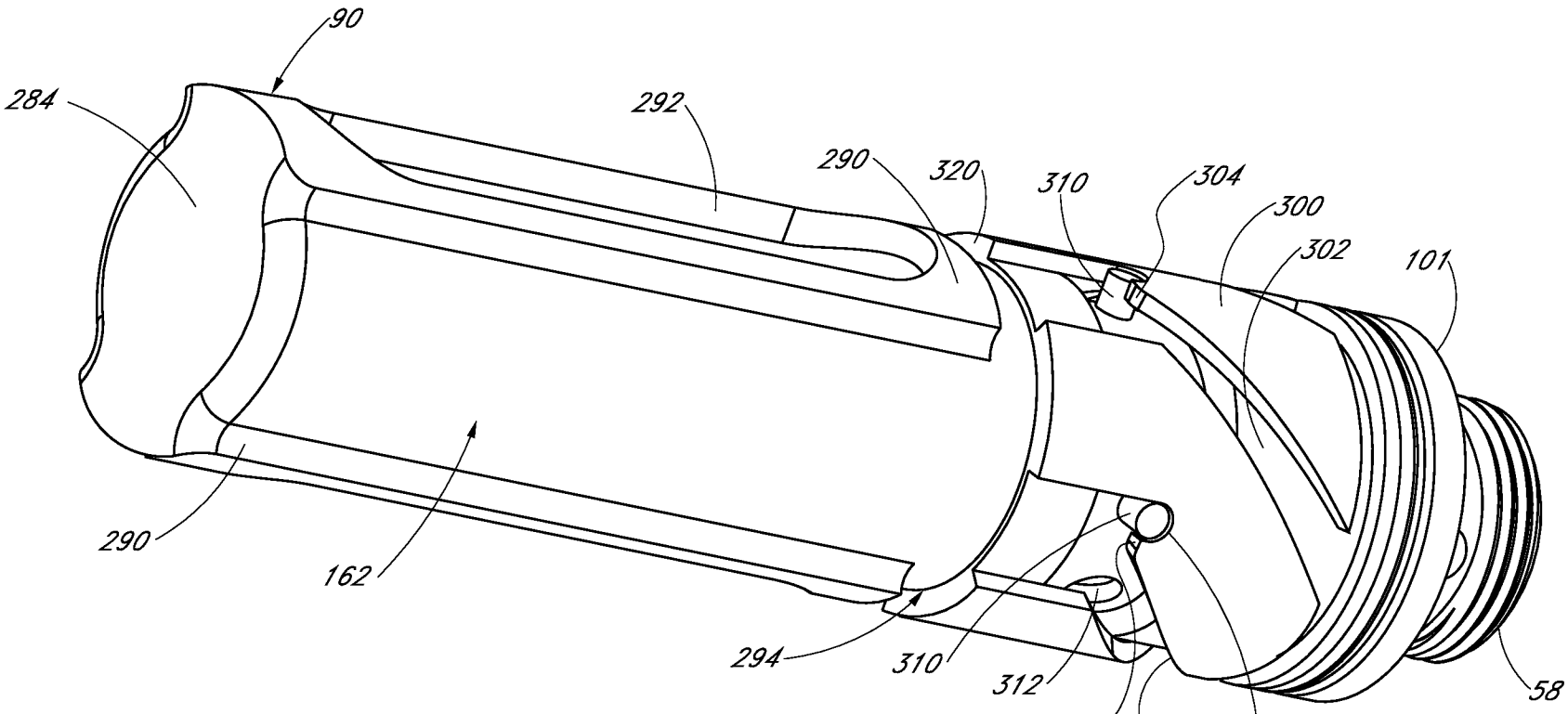
FIG. 35 shows the arrangement of FIG. 34 assembled.

With particular reference next to FIGS. 34 and 35, the illustrated guide 90 is configured to receive a media vial 66 within a guide lumen 94 thereof, and has an end wall 284 at a proximal end thereof. A pair of slots 162 are defined between raised portions 290 that each define a window 292. In the illustrated embodiment the windows 292 are sized and configured to match corresponding windows 96 formed in the sleeve 85, which is configured to receive the guide 90 therewithin—most preferably in a manner such that the sleeve 85 and guide 90 move together as one.

A distal manifold 294 is defined distal of the raised portions 290 and in communication with each slot 162. A latching portion 296 extends distally from the distal manifold 294. The latching portion 296 comprises a plurality of legs 300, each separated by a latch slot 302 that extends from an open distal end to the distal manifold 294. A ridge 304 and a catch 306 are defined within each latch slot 302.

Figure 30:
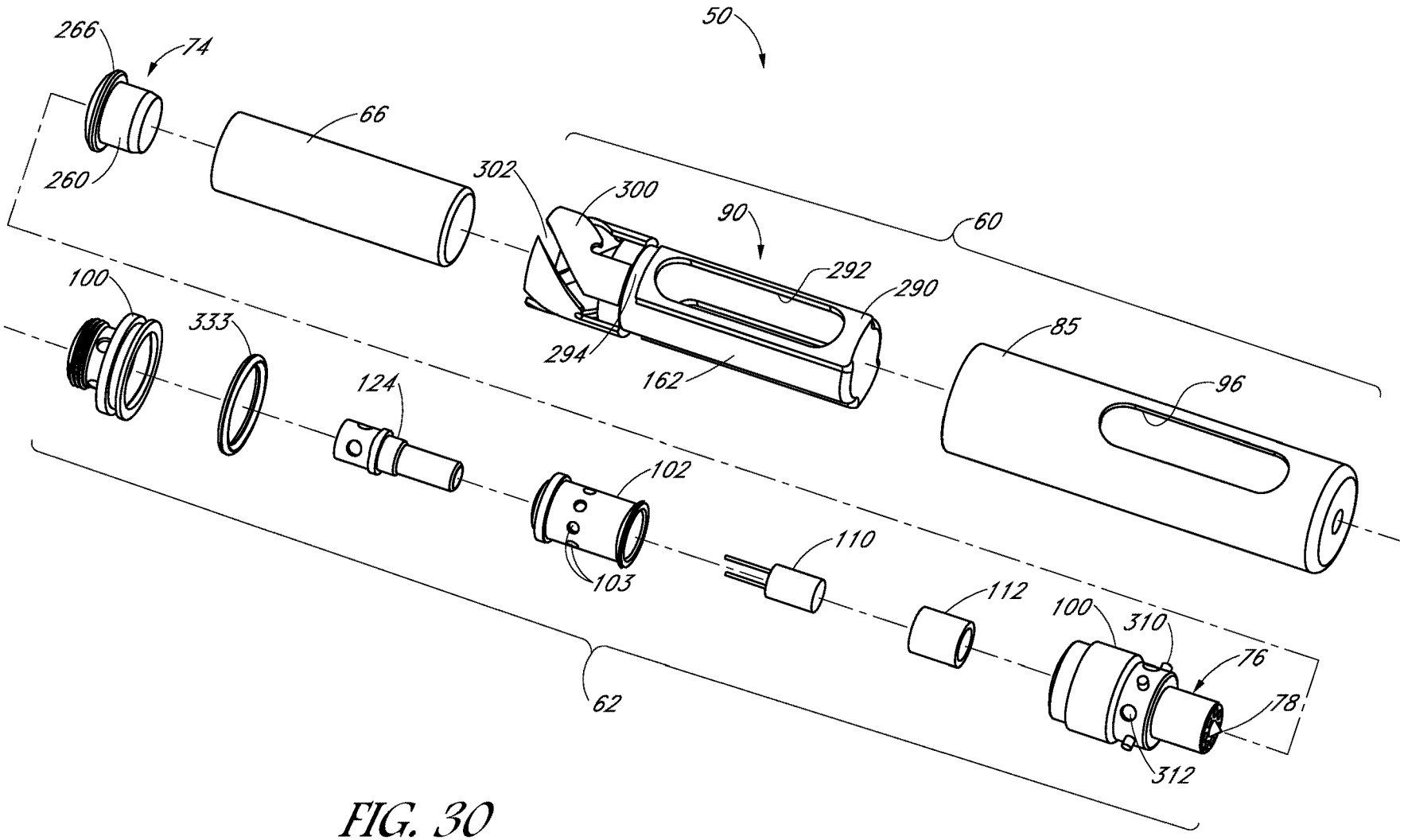
FIG. 30 is an exploded view of the personal vaporizer of FIG. 29.

Continuing with particular reference to FIGS. 30, 34 and 35, the illustrated base 100 includes a vial receiver portion 76 and a latching structure 298. A proximal portion of the latching structure 298 comprises a plurality of circumferentially-spaced latch pins 310 and a plurality of circumferentially-spaced apertures 312. A distal portion of the latching structure 298 is configured to be press-fit into a mount base 101 that includes the battery mount 58. The base insert 102 can be enclosed within the base 100.

Each of the latch pins 310 is configured to be received into the open end of a corresponding latch slot 302 of the guide 90 and advanced over the ridge 304 and into the catch 306 so as to attach the guide 90 (and attached sleeve 85) to the base 100. When such attachment takes place when a media vial 66 is disposed within the guide lumen 94, as the guide 90 and vial 66 are advanced over the base 100, the puncture tip 78 punctures the vial closure valve 272, separating the valve into flaps 282 that bend out of the way into the skirt opening 278 (see FIGS. 36 and 37) as the vial receiver 76 portion is advanced. Preferably, the resilient rim 270 of the vial closure 74 engages a seat 316 adjacent the vial receiver 76 portion before the latch pin 310 clears the ridge 304. A user then applies additional pressure to compress the resilient rim 270 so that the latch pin 310 clears the ridge 304 and enters the catch 306. Pressure exerted by the resilient rim 270 will then keep the latch pin 310 engaged in the catch 306, preventing it from passing over the ridge 304 unless and until sufficient longitudinal force is again applied to compress the resilient rim 270 sufficient to move the latch pin 310 over the ridge 304. Preferably the vaporizer 50 is configured so that the level of compression necessary to operate the latching mechanism 298 is of a magnitude to be expected from an adult. In this manner, the illustrated latching mechanism 298 provides a child-lock configuration. Notably also, the battery mount 58 comprises a threaded connection. As such, if a child were to attempt to disassemble the vaporizer 50, such as by twisting to unthread components, the battery 250 may be removed but no access would be granted to the media vial 66.

Figure 36:
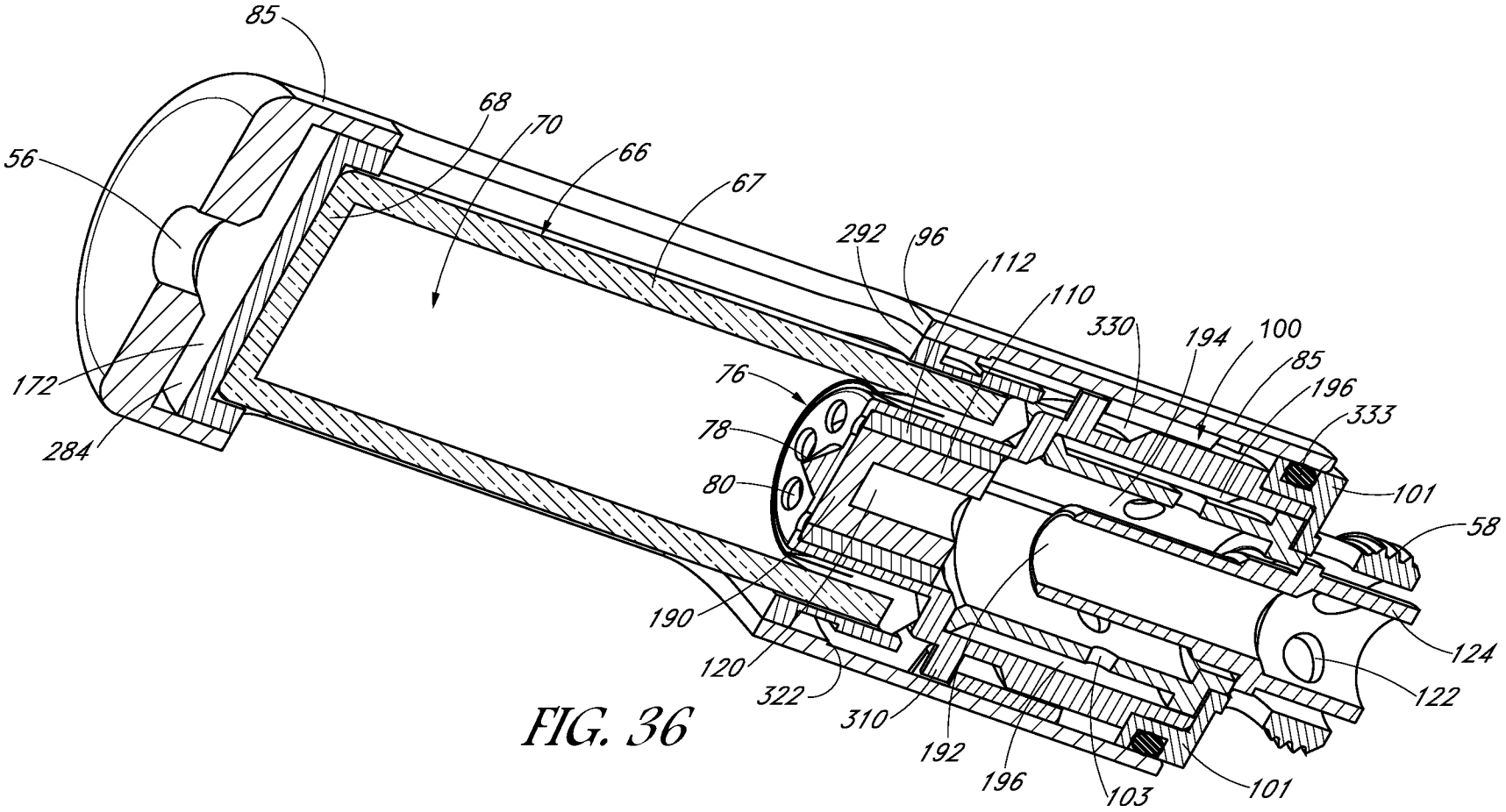
FIG. 36 is a cross-sectional view taken along line 36-36 of FIG. 29.
Figure 37:
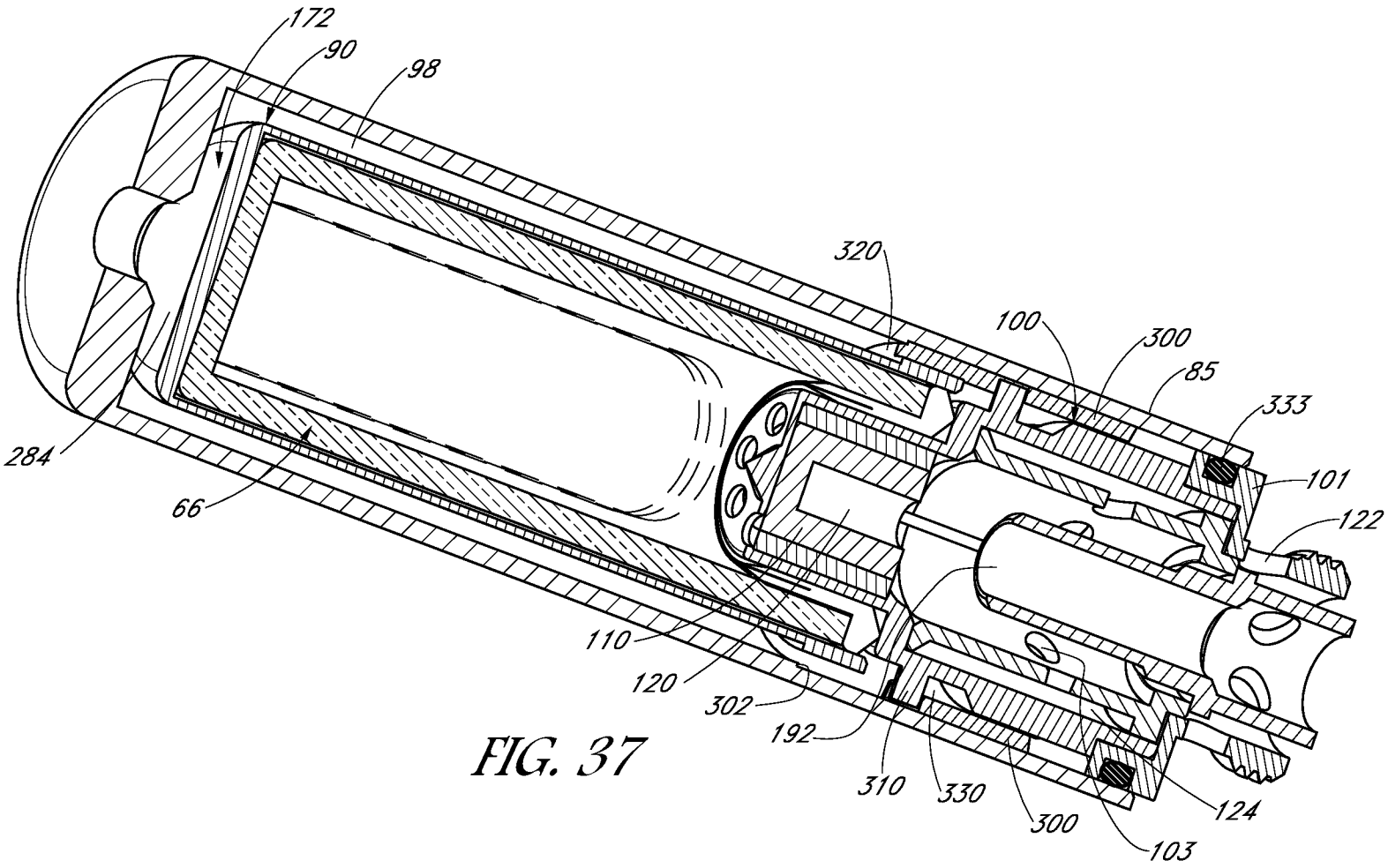
FIG. 37 is a cross-sectional view taken along line 37-37 of FIG. 29.

With additional reference to FIGS. 36 and 37, a shoulder 320 is defined by an offset surface at the proximal ends of the legs 300. In the illustrated embodiment an outer diameter of the guide 90 at the legs 300 and shoulder 320 is greater than an outer diameter at the raised portion 290. The sleeve 85 has a proximal inner diameter that approximates the outer diameter at the raised portion 290 and a distal inner diameter that approximates the outer diameter at the legs 300. An offset surface 322 is defined between the proximal inner diameter and distal inner diameter. Preferably the offset surface 322 is configured to engage the shoulder 320 so as to prevent the sleeve 85 from moving further distally over the guide 90. In this manner the end wall 284 of the guide 90 is spaced from a proximal wall of the sleeve 85, defining a proximal vapor manifold 172 that communicates with the vapor paths 98.

In the illustrated embodiment, an inner diameter of the guide 90 in the legs 300 is greater than an outer diameter of the proximal portion of the base 100, and about the same as an outer diameter of the distal portion of the base 100. As such, an open space 330 is defined between the outer surface of the base 100 proximal portion and the inner surface of the legs 300. The open space 330 communicates with the apertures 312 and also the distal manifold 294.

In the illustrated embodiment, the mount base 101 comprises an o-ring seat that receives an o-ring 333. The sleeve 85 is sized and configured so that, when the proximal and distal portions of the vaporizer 50 are attached, the inner surface of the sleeve 85 sealingly contacts the o-ring 333.

With continued referenced to FIGS. 36 and 37, during use, as a user draws a breath through a vapor outlet 56, air A is drawn in through the conductive pin 124 and directed into the vaporizing chamber 120 within the ceramic wick 110, where it mixes with atomized media M to form vapor V. The vapor V is directed into the vapor space 194 between the conductive pin 124 and the base insert 102 and proceeds through apertures 103 (which, preferably, are disposed distal of the proximal opening of the conductive pin 124) into the secondary vapor space 196 defined between the base insert 102 and the base 100. From the secondary vapor space 196 vapor V flows through apertures 312 of the base proximal portion into the open space 330, from which it is directed to the distal manifold 294 of the guide 90 and further to the vapor paths 98. From the vapor paths 98 the vapor V is directed to the proximal vapor manifold 172, from which it exits the vaporizer 50 through the proximal vapor outlet 56.

As mentioned above, vaporizing media M comes in many forms, and can have many different forms and flow characteristics at room temperature. For example, e-liquids and some CBD oils can be expected to have room temperature viscosity in the range of about 40-200 centipoise (cp). However, it is not uncommon for thick oils to have room-temperature viscosities in the range of about 2000 cp (which is barely flowable at room temperature) to about 20,000 cp. Solid media such as waxes and crystalline solids can have room-temperature viscosities in the order of 100,000+cp. As such, depending on the media, media flow from the vial 66 to the ceramic wick 110, and wicking flow into and through the wick, may or may not be a significant consideration.

In preferred embodiments it is desired to transform high-viscosity media to reduce viscosity (as needed) to about 100-150 cp in order to obtain suitable media flow so that a steady flow of media M impinges on and flows into and through the ceramic wick 110 in order to ensure consistent atomization and high quality vapor production. As discussed above, preferably warming elements (such as the spear 210 and/or portions of the vial receiver 76), are heated sufficiently to melt/reduce viscosity of media while not atomizing such media. More preferably, such warming heat is controlled to avoid initiating breakdown of certain media aspects while reducing media viscosity. For example, in some CBD-based media, organic terpenes in the media begin to break down above 130° F. Preferably, it is desired to avoid breakdown of such aspects—at least prior to atomization. Thus, in some embodiments, secondary heating elements such as the spear and/or surfaces of the vial receiver 76 preferably are heated to a maximum of 130° F.

In some embodiments the closure 74 can include a tab or other structure configured so that a user can remove/open the closure 74 before use instead of relying upon the puncture tip 78 to puncture the closure 74. Additionally, rather than employ seals such as the o-rings that engage and seal the inner surface of the vial 66, other embodiments of personal vaporizers can employ sealing members, such as elastomeric o-rings, supported on other vaporizer structure such as the base 100, and configured to sealingly engage the outer surface of the vial 66.

In still further embodiments, the distal end of the vial 66, and particularly the inner surface thereof, can be coated with an elastomeric coating configured to engage and establish a seal with the vial receiver 76.

In still further embodiments, the vial 66 can include outer or inner threads configured to mate with corresponding threads on the vial receiver 76, guide 90 of the proximal portion, base 100, or the like so that the vial 66 is threadingly attached to the vaporizer 50. Such threading attachment can occur before, during, or after the stopper 74 has been punctured.

In yet additional embodiments the vial can include a resealable stopper 74, and the puncture tip 78 of the vial receiver 76 can be configured to puncture the stopper 74 and gain access to the media tank 70 within the vial 66 without destroying the stopper 74. In such an embodiment the puncture tip 78 preferably is included as part of a hollow needle through which media can flow. Preferably the vial can be removed from the vaporizer 50 and remain sealed.

The illustrated embodiments envision separating the vaporizer 50 into proximal and distal portions 60, 62 in order to insert the vial 66 therebetween. In additional embodiments this configuration can be modified so that the vaporizer 50 doesn't need to be so disassembled. For example, in some embodiments a side slot can be provided so that a vial can be inserted through a side wall of the vaporizer and then advanced onto the vial receiver 76. Vapor passages within the vaporizer 50 can be configured to avoid the side slot.

In yet further embodiments, rather than being releasably attachable to a separately-formed battery, a vaporizer 50 can be formed so that the battery is permanently attached, preferably as part of the distal portion 62 of the personal vaporizer 50.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. For example, child-proofing latching mechanisms consistent with FIGS. 29-37 can also be used with wicking and/or power structures discussed in other embodiments to construct further personal vaporizers. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A personal vaporizer, comprising:

an elongated guide enclosing a tank that is configured to hold a vaporizing media;

a base enclosing a vaporization chamber and having an inlet, an inlet passage, a vapor space and an outlet, the inlet passage configured to direct air from the inlet to the vaporization chamber, the vapor space configured to receive vapor from the vaporization chamber and communicating with the outlet;

the guide and base being selectively attachable to one another via a connecting structure, the connecting structure comprising a pin on one of the base and guide and a slot on the other of the base and guide, the pin being configured to slide within the slot to attach the guide to the base;

wherein when the guide is attached to the base, the outlet is in communication with the slot; and wherein the slot is in communication with a vapor path formed at least partly by the guide.

2. The personal vaporizer of claim 1, additionally comprising a sleeve extending over the guide, the vapor passage is defined between the guide and the sleeve, and the vapor passage extends adjacent the tank to a mouthpiece on a side of the tank opposite the vapor space.

3. The personal vaporizer of claim 2, wherein the sleeve is selectively removable from the guide.

4. The personal vaporizer of claim 3, wherein the guide has a raised portion having a guide outer diameter, and an elongated guide slot is formed adjacent the raised portion, and wherein the sleeve has a first sleeve inner diameter that approximates the guide outer diameter so that the vapor passage is defined between the guide slot and the sleeve, and vapor in the vapor passage is blocked from flowing between the raised portion and the sleeve.

5. The personal vaporizer of claim 4 additionally comprising a guide aperture formed through the raised portion, the guide aperture spaced from the guide slot and providing a view of the tank within the guide, and wherein a sleeve aperture is formed through the sleeve and configured to align with the guide aperture.

6. The personal vaporizer of claim 4, wherein the guide comprises a distal manifold interposed between the slot and the guide slot so that vapor in the slot can flow through the distal manifold and into the guide slot.

7. The personal vaporizer of claim 1, wherein the connecting structure is a bayonet style connector, and wherein the pin is disposed on the base and the slot is disposed on the guide, and wherein the outlet is spaced radially from the guide.

8. The personal vaporizer of claim 1, wherein the tank comprises an opening, a valve disposed within the opening, an inner seal portion of the valve engaging an inner surface of the tank and extending into the tank from the opening to a seal end, the inner seal portion having an inner diameter, a flap portion of the valve extending from the inner seal portion and spanning across the valve so as to block flow of media out of the tank, the flap portion disposed between the opening and the seal end.

9. The personal vaporizer of claim 8, wherein the base comprises a receiver having a puncture tip configured to puncture the flap portion, an outer diameter of the receiver approximating the inner surface of the inner seal portion so that a seal is established between the receiver and the inner seal when the receiver is advanced into the valve.

10. The personal vaporizer of claim 9, wherein the inner seal portion between the flap portion and the seal end has an end thickness, the flap portion has a flap thickness, and the inner seal portion between the opening and the flap portion has a upper end thickness, and wherein the combined end thickness and flap portion thickness is no greater than the upper end thickness.

11. The personal vaporizer of claim 1, wherein the tank comprises an opening and a sealing structure disposed across the opening, and the tank comprises a receiver having a puncture tip configured to puncture the sealing structure and extend into the tank, one or more feeders disposed distal of the puncture tip and communicating with the vaporization chamber, and wherein the puncture tip is in thermal communication with the vaporization chamber so that a portion of heat from the vaporization chamber is communicated by the tip to a media within the tank.

12. The personal vaporizer of claim 1, wherein the tank comprises a vial having an outer wall and an opening, the vial being removable from the guide, and a valve is disposed within the opening.

13. The personal vaporizer of claim 1, wherein the vaporization chamber is defined by a wick having a distal opening, an elongated side wall, and a proximal wall, and wherein the inlet passage has a proximal tip aligned with the distal opening so that air flowing through the input passage is directed into the distal opening.

14. The personal vaporizer of claim 13, wherein the distal tip is disposed distal of the distal opening.

15. The personal vaporizer of claim 13, additionally comprising a vapor space disposed distal of the wick, the vapor space having a vapor space opening radially spaced from the wick distal opening and distal of the proximal tip of the inlet passage.

16. The personal vaporizer of claim 15, wherein a secondary vapor space is disposed between the vapor space opening and an outer wall of the base, and the outlet is formed through the outer wall of the base and communicating with the secondary vapor space, and the outlet is arranged proximal of the vapor space opening.

17. The personal vaporizer of claim 16, wherein the guide is radially spaced from the base at the outlet.

* * * * *